US005601065A

United States Patent [19]

Tamura et al.

[11] Patent Number: 5,601,065

[45] Date of Patent: Feb. 11, 1997

[54] FUEL EVAPORATION GAS TRANSPIRATION PREVENTION SYSTEM

[75] Inventors: Hiroshi Tamura, Kariya; Junya Morikawa, Kasugai; Kazuto Maeda, Nisshin; Nobuhiko Koyama, Nagoya, all of Japan

[73] Assignee: Nippondenso Co., Ltd., Kariya, Japan

[21] Appl. No.: 427,908

[22] Filed: Apr. 26, 1995

[30] Foreign Application Priority Data

Apr. 27, 1994 [JP] Japan ..... 6-089295

[51] Int. Cl.$^6$ ..... F02M 37/04

[52] U.S. Cl. ..... 123/516; 123/198 D

[58] Field of Search ..... 123/520, 521, 123/198 D, 516, 518, 519

[56] References Cited

U.S. PATENT DOCUMENTS

| | | | |
|---|---|---|---|
| 4,872,439 | 10/1989 | Sonoda | 123/516 |
| 5,067,468 | 11/1991 | Otowa | 123/516 |
| 5,193,512 | 3/1993 | Steinbrenner et al. . | |
| 5,209,210 | 5/1993 | Ikeda | 123/516 |
| 5,280,775 | 1/1994 | Tanamura | 123/518 |
| 5,317,909 | 6/1994 | Yamada et al. . | |
| 5,375,529 | 12/1994 | Mukai | 123/516 |
| 5,445,133 | 8/1995 | Nemoto | 123/520 |

FOREIGN PATENT DOCUMENTS

| | | | |
|---|---|---|---|
| 0164763 | 12/1980 | Japan | 123/518 |
| 1-142258 | 6/1989 | Japan . | |
| 4-125655 | 11/1992 | Japan . | |
| 6-193519 | 7/1994 | Japan . | |

*Primary Examiner*—Carl S. Miller

*Attorney, Agent, or Firm*—Cushman, Darby & Cushman

[57] ABSTRACT

When refueling is started, a purge valve is closed, and power is supplied to a coil of a solenoid so that a constant pressure operating valve of an atmospheric escape valve is opened. When the temperature of the fuel tank rises while an engine is at a stop, fuel evaporation gas generates and the pressure within the fuel tank increases. When the differential pressure between the in-tank pressure and the atmospheric pressure increases, a first communication passage is opened, and the pressure is released to the outside. Thus, the pressure within the fuel tank can be maintained at an appropriately high pressure level while the vehicle is at a stop, and the quantity of the fuel evaporation gas generating while the vehicle is at a stop can be controlled.

13 Claims, 15 Drawing Sheets

FUEL EVAPORATION GAS TRANSPIRATION PREVENTION SYSTEM

CROSS REFERENCE TO RELATED APPLICATION

This application is based upon and claims priority of Japanese Patent Application No. 6-89295 filed on Apr. 27, 1994, the disclosure of which is incorporated herein by reference.

BACKGROUND OF THE INVENTION

1. Field of the Invention

The present invention generally relates to a fuel evaporation gas transpiration prevention system for vehicles. More particularly, the present invention relates to a system for preventing the transpiration of fuel evaporation gas generated within a fuel supply system of an internal combustion engine of vehicles.

2. Description of Related Art

A system for preventing the transpiration of fuel evaporation gas generated within a fuel supply system of an internal combustion engine is disclosed in the Japanese Unexamined Patent Publication Laid-open No. 4-318268. According to the system disclosed in this publication, a fuel tank and a canister which adsorbs fuel evaporation gas communicate with each other with a single communication pipe, and within this communication pipe is disposed a two-way valve, while in the canister an atmospheric escape hole is provided.

In the system disclosed in above publication, fuel evaporation gas generated within the fuel tank during the refueling flows into the canister through the two-way valve and is adsorbed in an adsorbent within the canister. However, as the two-way valve does not open unless the pressure within the fuel tank increases to be larger than the pressure in the canister by a specified value, a part of the fuel evaporation gas generated within the fuel tank is released into the atmosphere through a bypass for refueling provided within the fuel tank until the pressure within the fuel tank increases to exceed a specified value.

SUMMARY OF THE INVENTION

In view of the above problem, it is a primary object of the present invention to provide a fuel evaporation gas transpiration prevention system which can control the release of the fuel evaporation gas during the refueling by using an apparatus which communicates between a fuel tank and a canister via a single pipe.

According to a first aspect of the present invention a fuel tank stores fuel to be supplied to an internal combustion engine, a canister adsorbs fuel evaporation gas in an adsorbent which adsorbs fuel evaporation gas, a communication pipe communicates between the fuel tank and the canister, and a refueling determination is made as to whether or not the vehicle is in refueling condition. A valve unit connects the canister and atmosphere when at least one of the following conditions is satisfied (1) the tank is being refuelled, (2) the tank is not being refuelled and a pressure within the fuel tank increases to be higher than the atmospheric pressure, or (3) the tank is not being refuelled and the fuel evaporation gas is supplied from the canister to an intake pipe. The valve unit shuts off the canister from the atmosphere in any other cases.

According to a second aspect of the present invention, a fuel tank stores fuel to be supplied to an internal combustion engine, a canister adsorbs fuel evaporation gas in an adsorbent which adsorbs fuel evaporation gas, and a communication pipe communicates between the fuel tank and the canister. It is determined as to whether or not the vehicle is in refueling. An open valve connects the canister to atmosphere when the tank is in refuelling and shuts off when the tank is not refueling. A pressure control valve connects the canister with the atmosphere when a pressure within the fuel tank increases to be higher than the atmospheric pressure by a specified value or more to decrease the pressure within the fuel tank to be smaller than the specified value. An atmospheric introduction valve connects the canister with the atmosphere when fuel evaporation gas is supplied from the canister to an intake pipe.

Preferably, the canister is divided into two chambers by a partition. On an end of the partition is provided a communication part which connects the two chambers. One of the two chambers is connected to the communication pipe on the side opposite the communication part, and the other of the two chambers is connected to the open valve on the side opposite the communication part.

Preferably, the communication valve is provided in the communication pipe and connects the canister with the fuel tank when the refueling is made or when the pressure within the fuel tank increases to be higher than the atmospheric pressure by the specified value or more.

Preferably, the open valve is mechanically linked so as to operate according to the refueling condition, i.e., open during the refuelling and close when the vehicle is not being refueled.

DETAILED DESCRIPTION OF THE PREFERRED EMBODIMENTS

Hereinafter, embodiments of the present invention will be described referring to the appended drawings.

Figure 1:
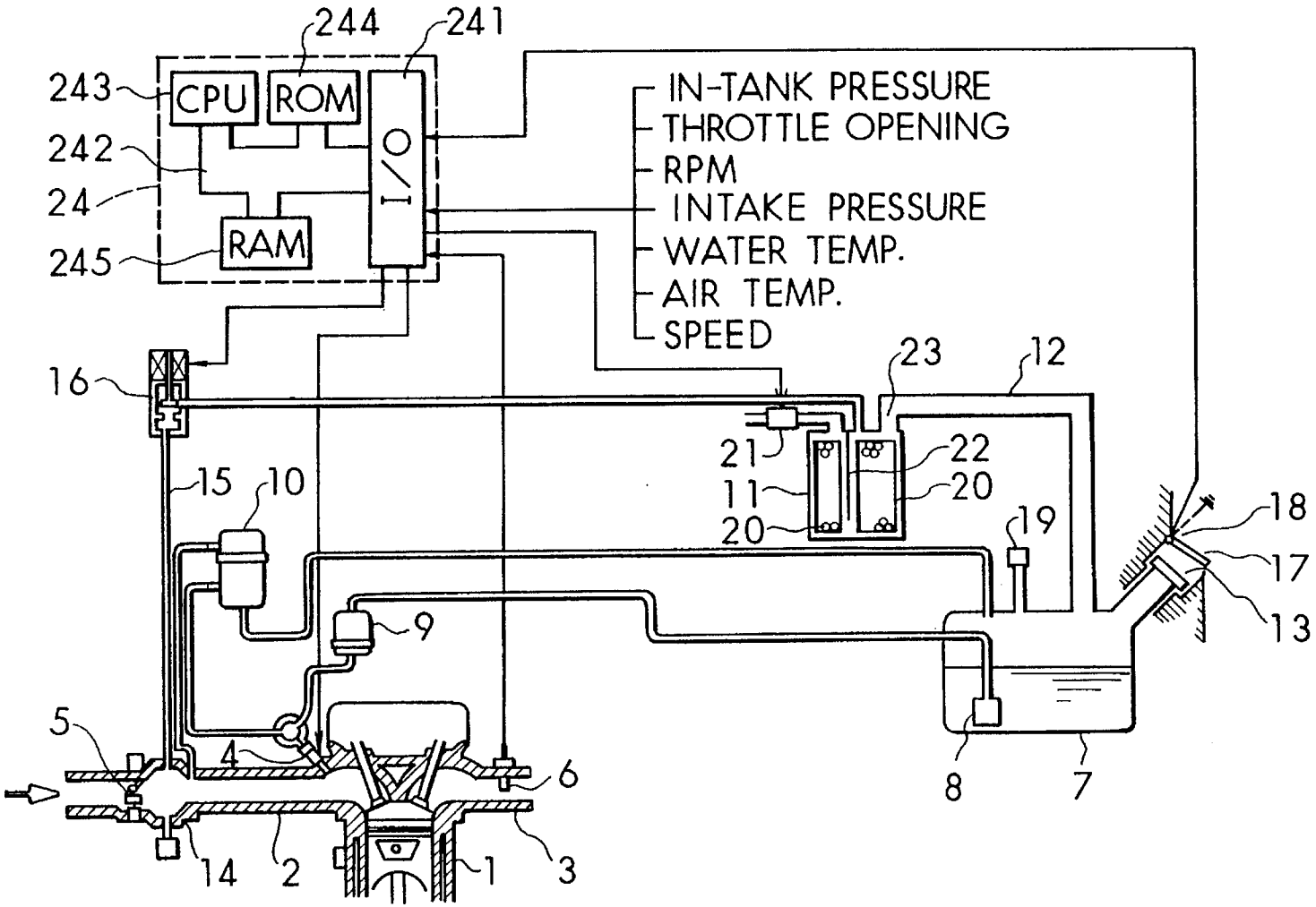
FIG. 1 is a system constructional view illustrating a first embodiment according to the present invention.

FIG. 1 illustrates a system construction of a fuel transpiration prevention system according to the first embodiment.

As illustrated in this figure, a multi-cylinder internal combustion engine (hereinafter referred to as "engine") 1 is mounted on a vehicle. To the engine 1 are connected an intake pipe 2 and an exhaust pipe 3. In the inner end part of the intake pipe 2 is provided an electromagnetic injector 4 and in the upstream from the injector 4 is provided a throttle valve 5. In the exhaust pipe 3 is provided an oxygen sensor 6, which outputs voltage signals to an ECU 24 according to the oxygen concentration within exhaust gas.

A fuel supply system supplying fuel to the injector 4 is composed of a fuel tank 7, a fuel pump 8, a fuel filter 9 and a pressure regulation valve 10. Fuel (gasoline) within the fuel tank 7 is forcedly fed through the fuel filter 9 to each injector 4 by the fuel pump 8, while the fuel to be supplied to each injector 4 is regulated to a specified pressure by the pressure regulation valve 10.

On the top of the fuel tank 7 is provided a communication pipe 12 which guides fuel evaporation gas generated within the fuel tank 7 into a canister 11. Incidentally, the inside diameter of the communication pipe 12 is designed to be sufficiently large for the fuel evaporation gas to flow therethrough from the fuel tank 7 to the canister 11 during refueling (e.g., 1–2 cm in diameter), whereby the escape of the fuel evaporation gas from the fuel supply port 13 during the refueling can be controlled.

The canister 11 and a surge tank 14 communicate with each other through a purge pipe 15, and in the purge pipe 15 is provided a variable flow rate solenoid valve (hereinafter referred to as "purge valve") 16. The purge valve 16 is duty-driven based on a purge percentage (percentage of purge flow rate to the intake air flow rate) preset according to the operational condition of the engine 1.

The fuel tank 7 is provided with a refueling detection switch 18 which detects the refueling based on the open/close operation of a fuel filler lid 17. This refueling detection switch 18 may be arranged to be linked with some component which is operated during the refueling, such as a fuel cap and a lid opener. The fuel tank 7 is also provided with an in-tank pressure sensor 19 which detects the pressure within the fuel tank 7 (hereinafter referred to as "in-tank pressure"). Incidentally, the in-tank pressure sensor 19 is a relative pressure sensor which detects the differential pressure between the atmospheric pressure and the in-tank pressure.

The canister 11 is provided with an adsorbent 20 which adsorbs fuel evaporation gas, and further with an atmospheric escape valve 21 which is composed of a solenoid-valve-integrated large diameter diaphragm valve and which also serves as a check valve. This atmospheric escape valve 21 is provided on the side opposite to an introduction opening 23 across a partition 22. By providing the atmospheric escape valve 21 in this manner, a large quantity of fuel evaporation gas generated during the refueling flows from the introduction opening 23 toward the atmospheric escape valve 21 by detouring the partition 22. Accordingly, the fuel evaporation gas can effectively be adsorbed in the adsorbent 20 on the way. Here, the atmospheric escape valve 21 is designed so as to remain open during the refueling.

Next, referring to FIGS. 2 and 3, the construction of the atmospheric escape valve 21 will be described. As the atmospheric escape valve 21, this embodiment uses a valve mechanism disclosed in the Japanese Unexamined Utility Model Publication Laid-open No. 4-125655.

Figure 2:
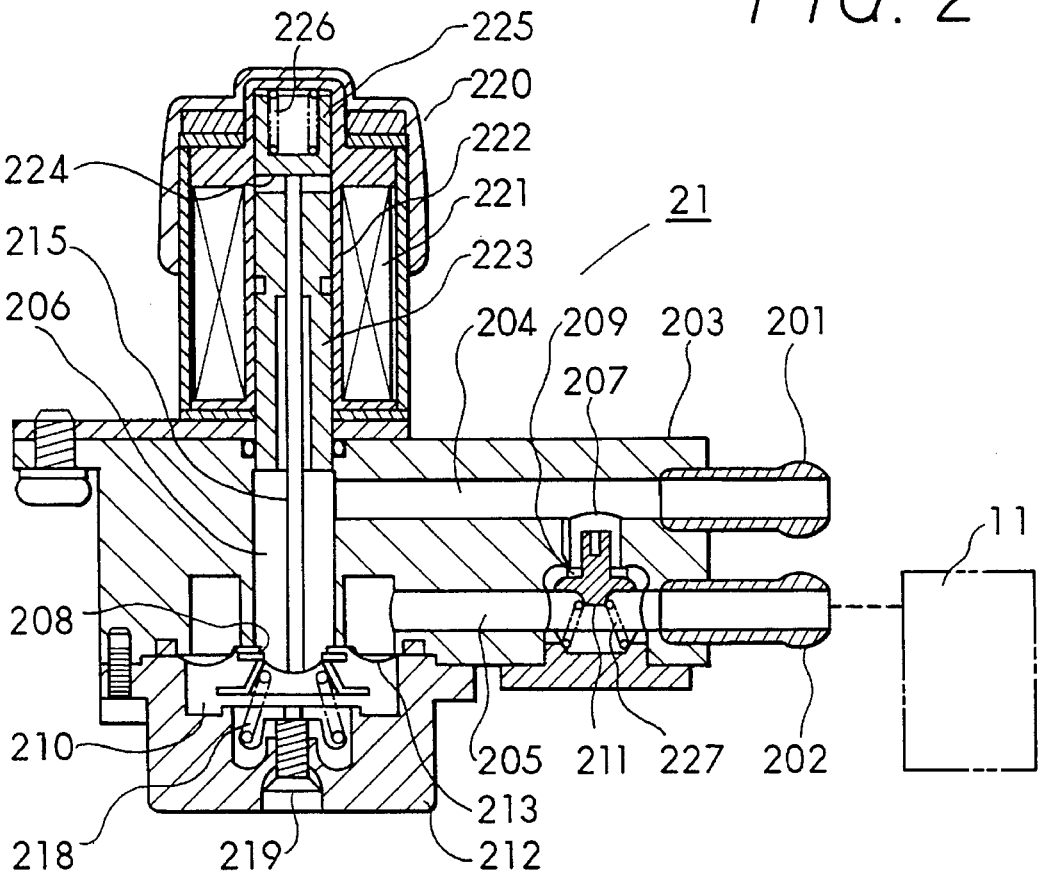
FIG. 2 is a cross-sectional view illustrating the construction of an atmospheric escape valve of the first embodiment.

In FIG. 2, the atmospheric escape valve 21 is connected with the canister 11 through a joint valve 202. A joint valve 201 is open to the atmosphere. Within a housing 203 are provided an atmosphere passage 204 leading to the joint valve 201 and a canister passage 205 leading to the joint valve 202.

The atmosphere passage 204 and the canister passage 205 communicate with each other through a first communication passage 206 and a second communication passage 207. To a valve seat 208 made within the first communication passage 206 and a valve seat 209 made within the second communication passage 207, both on the side of the canister passage 205, are seatably provided a constant pressure operating valve 210 and a differential pressure operating valve 211, respectively. The differential pressure operating valve 211 is disposed upstream from the constant pressure operating valve 210.

The constant pressure operating valve 210 is floatably supported in the upper part of a cup 212 mounted to the bottom part of the housing 203. Now, this constant pressure operating valve 210 will be described referring to an enlarged view in FIG. 3.

Figure 3:
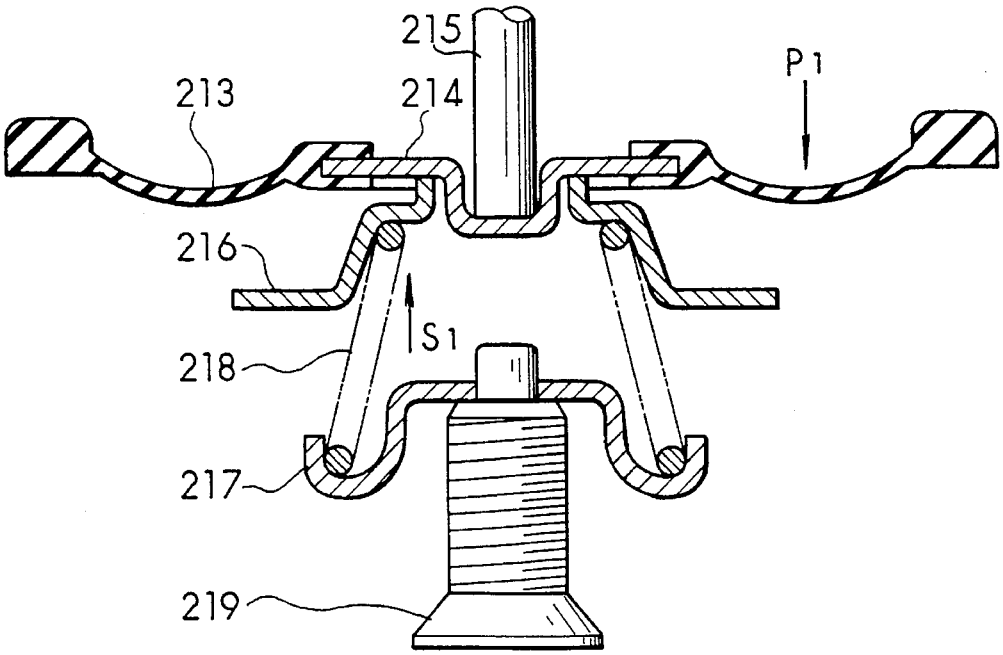
FIG. 3 is an enlarged cross-sectional view illustrating the construction of a part of the atmospheric escape valve.

As evident from FIG. 3, the valve part of the constant pressure operating valve 210 is composed of a diaphragm 213. To the center of a plate 214, which is made integrally with the constant pressure operating valve 210 in the central position thereof, is forcedly contacted an end of a shaft 215. The diaphragm 213 is made of fluororubber having a high resistance to alcohol.

Between a retainer 216 provided integrally with the plate 214 and a retainer provided on the side of the cup 212 is compressedly provided a first set spring 218 shaped in a coil, which presses the diaphragm 213 to the closing position (upward) with a set load $S_1$. It is a condition of opening the constant pressure operating valve 210 that the pressure within the canister 11 exceed a specified value $P_1$ which is equal to or larger than the set load $S_1$ ($P_1 \geqq S_1$). In this embodiment, the set load $S_1$ is set to a pressure larger than the atmospheric pressure by 250 mmAq so that the in-tank pressure can increase to such an extent that the increase in the pressure does not burden the fuel tank 7 while the vehicle is at a stop. By raising the in-tank pressure while the vehicle is at a stop, the quantity of the fuel evaporation gas generated when the temperature within the fuel tank 7 rises while the vehicle is at a stop can be controlled. The retainer 217 is height-adjustably supported by an adjust bolt 219 to adjust the set load $S_1$ of the first set spring 218.

Referring to FIG. 2 again, the circumference of the diaphragm 213 is caught by and between the bottom part of the housing 203 and the flange part of the cup 212, and opened to the atmosphere through an opening (not illustrated) made in the cup 212.

When the diaphragm 213 is seated on the valve seat 208 by the first set spring 218, communication between the canister passage 205 and the first communication passage 206 is blocked, and the constant pressure operating valve 210 closes. Inversely, when the diaphragm 213 leaves the valve seat 208, the constant pressure operating valve 210 opens, and the canister passage 205 is communicated with the atmosphere passage 204 through the first communication passage 206.

The shaft 215 penetrates the first communication passage 206, and is movably (advance and retreat) supported by a solenoid 220 mounted on the housing 203 on the side opposite to the cup 212. The solenoid 220 includes a cylinder part 222 wound with a coil 221, a cylindrical stator core 223 housed inside the cylinder part 222 and a moving core 224 forcedly contacted to the other end of the shaft 215 penetrating the core of the stator core 223.

The moving core 224 which is separated from an end of the stator core 223 with a slight air gap 225 therebetween, is slidably housed within the cylinder part 222, and pressed toward the stator core 223 by a return spring 226. Here, the spring force of the return spring 226 is set to be weaker than the spring force of the first set spring 218.

The solenoid 220 is controlled by turning ON/OFF the electric power supply to the coil 221. In this embodiment, when a determination is made by the refueling detection switch 18 that the vehicle is in refueling, electric power is supplied to the coil 221 of the solenoid 220 to attract the core 224 downward, the constant pressure operating valve 210 is forcedly opened and the air flow from the fuel tank 7 into the canister 11 is activated, so that the fuel evaporation gas generated within the fuel tank 7 during the refueling can flow into the canister 11. When the vehicle is not in refueling, however, the electric power is not supplied to the coil 221 of the solenoid 220 to open the constant pressure operating valve 210.

As described above, when the coil 221 of the solenoid 220 is not in the electrically energized condition, an end of the shaft 215 is movably supported within the cylinder part 222. When the pressure within the canister 11 is larger than the specified value $P_1$, the diaphragm 213 leaves the valve seat 208 and the constant pressure operating valve 210 opens. Inversely, when the pressure within the canister 11 is smaller than the specified value $P_1$, the diaphragm 213 is seated on the valve seat 208 and the constant pressure operating valve 210 closes.

When the coil 221 of the solenoid 220 is in the electrically energized condition, the moving core 224 is magnetically attracted to the stator core 223, the shaft 215 is moved in the valve opening direction, the diaphragm 213 being pressingly contacted to an end of the shaft 215 leaves the valve seat 208, and the constant pressure operating valve 210 is forcedly opened. At this time, the opening of the constant pressure operating valve 210 is performed irrespective of whether the pressure within the canister 11 is larger or smaller than the specified valve $P_1$.

Only when the pressure within the canister 11 is smaller than the atmospheric pressure and the differential pressure between these two pressures exceeds the specified value $\Delta P$, which is equal to or larger than a set load $S_2$ of the second set spring 227 ($\Delta P \geqq S_2$), the differential pressure operating valve 211 leaves the valve seat 209 to open. Therefore, it is a condition of closing the differential pressure operating valve 211 that the differential pressure should be smaller than the specified value $\Delta P$. In this embodiment, the set load $S_2$ is set to 150 mmAq. In this arrangement, when the purge valve 16 is opened and the intake negative pressure is introduced into the canister 11 and this intake negative pressure lowers the pressure within the canister 11 to be smaller than the set load $S_2$, fresh air is introduced into the canister 11 through the differential pressure operating valve 211.

Referring to FIG. 1 again, a controller (hereinafter referred to as "ECU") 24 is composed of an input/output port (hereinafter referred to as "I/O port") 241, a common bus 242, a CPU 243. a ROM 244 and a RAM 245. Into the I/O port 241 are input signals including an in-tank pressure signal, a throttle opening signal, an engine rpm signals, an intake pressure signal, a cooling water temperature signal, an intake air temperature signal and a vehicle speed signal. These signals are subjected to analog-to-digital (A/D) conversion and sent to the common bus 242. The common bus 242 further sends the signals received from the I/O port 241 to the CPU 243 or to the RAM 245 according as necessary. The common bus 242 also sends values necessary for the operation of the CPU 243 from the ROM 244 and RAM 245 to the CPU 243, and furthermore sends the result of the operation of the CPU 243 to the I/O port 241.

Figure 4:
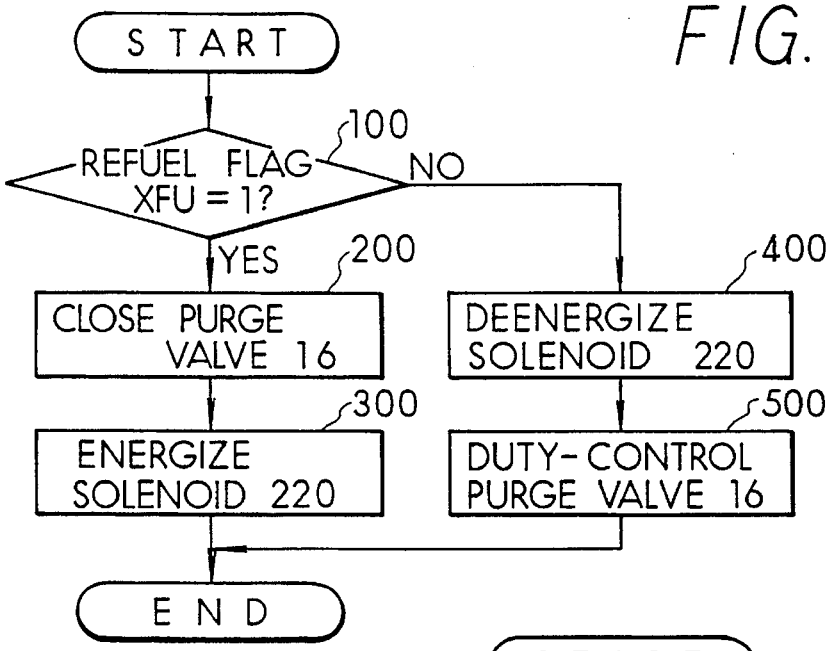
FIG. 4 is a process flow chart illustrating a driving process of each valve performed by an ECU.

The opening/closing of the atmospheric escape valve 21 and purge valve 16 is controlled based on the results of the operation of the ECU 24. The opening/closing process of the atmospheric escape valve 21 and purge valve 16 will be described referring to a process flow chart in FIG. 4. This process is executed with time interruption every specified time period (e.g., every 100 ms).

When this process starts, in Step 100, a determination is made whether or not a refueling flag XFU is "1." The refueling flag XFU is "1" when fuel is being supplied into the fuel tank 7, and "0" when fuel is not being supplied into the fuel tank 7. A determination whether or not fuel is being supplied into the fuel tank 7 is made by refueling determination process (described later). When the determination in Step 100 is positive (the determination is made that fuel is being supplied into the fuel tank 7), in Step 200, power supply to the coil of the purge valve 16 is stopped and the purge valve 16 closes. The process proceeds to Step 300, and power is supplied to the coil 221 to energize the solenoid 220 of the atmospheric escape valve 21, and the first communication passage 206 is forcedly opened, and this process is terminated.

When the determination in Step 100 is negative (the determination is made that fuel is not being supplied into the fuel tank 7), in Step 400, power supply to the coil 221 of the solenoid 220 is stopped or deenergized. In Step 500, the purge valve 16 is controlled to be driven at a duty ratio according to the operational condition of the engine 1, and this process is terminated.

Figure 5:
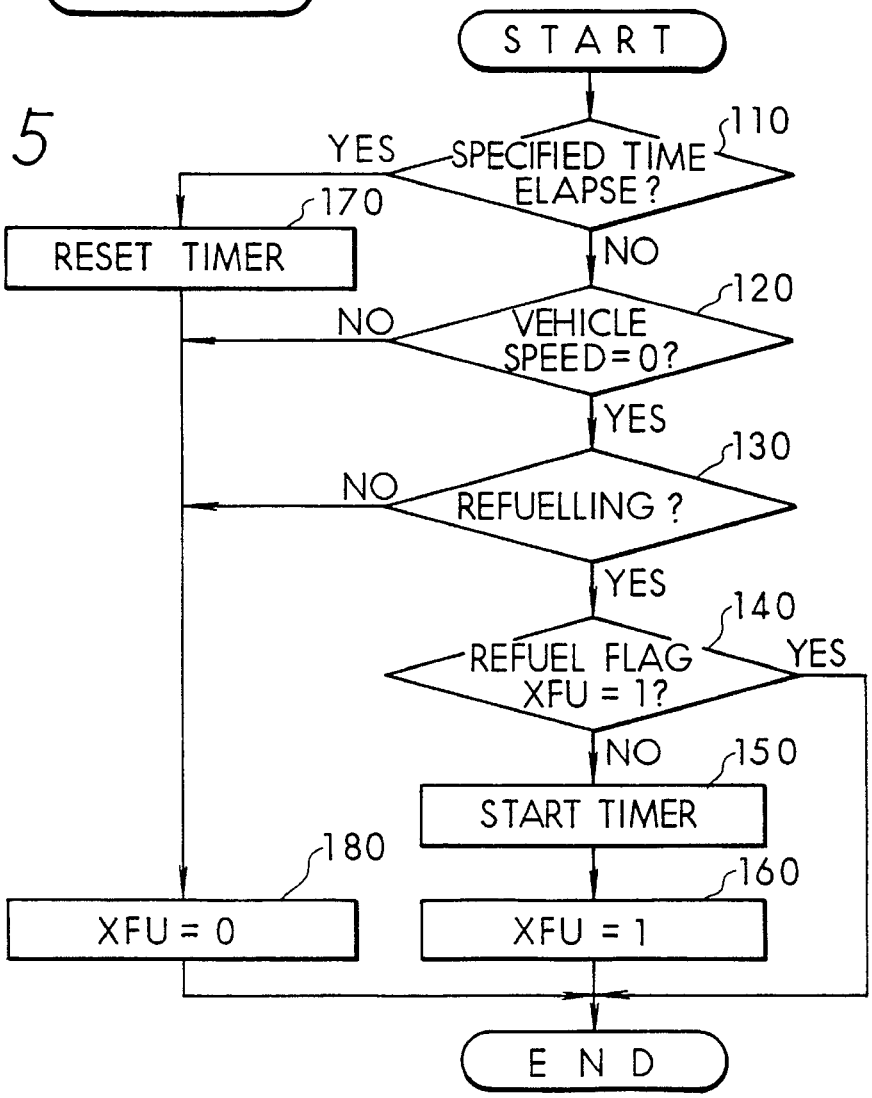
FIG. 5 is a process flow chart illustrating the driving process of each valve performed by the ECU.
Figures 6A, 6B, 6C, 6D, 6E:
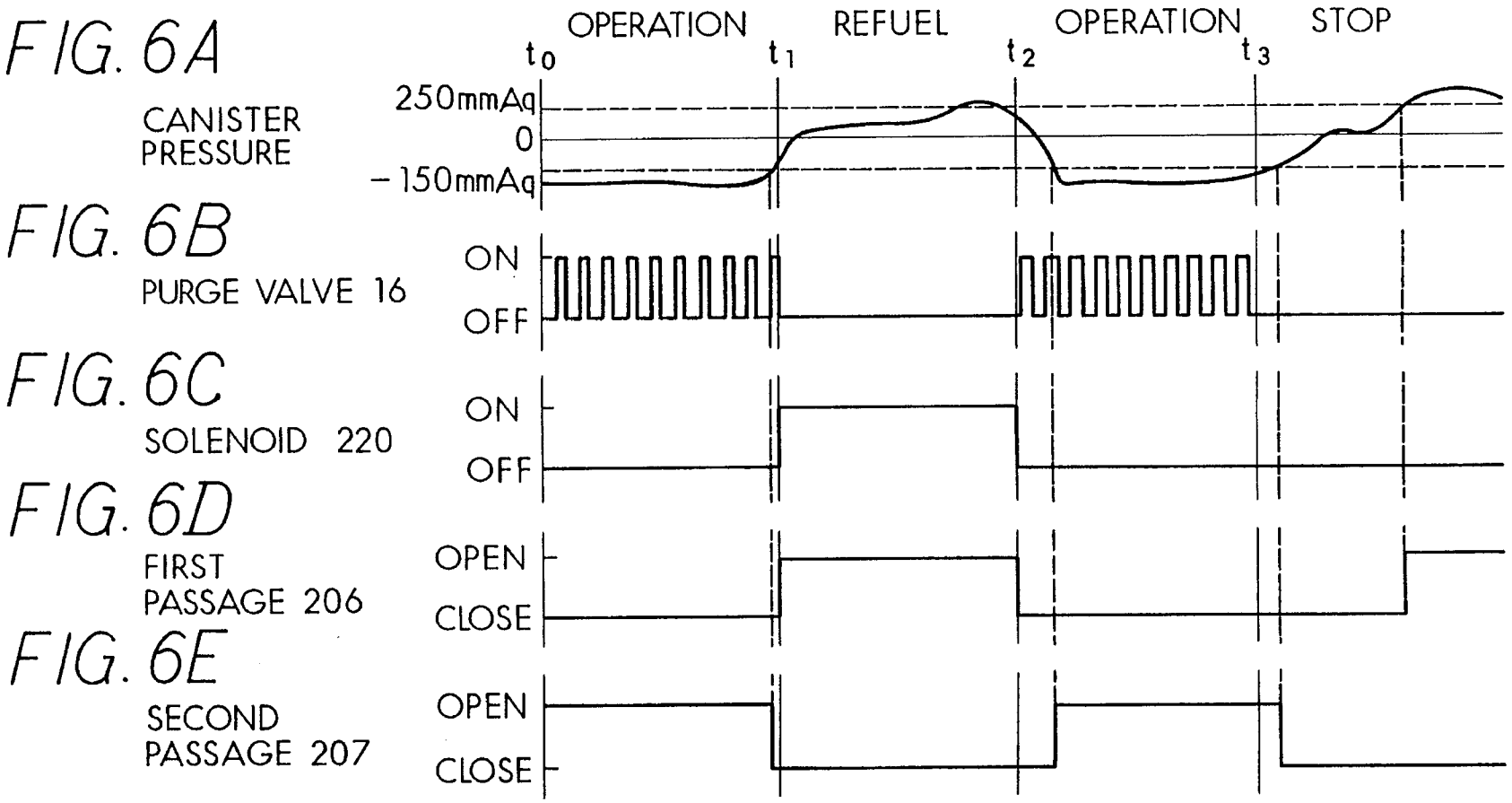
FIGS. 6A through 6E are time charts illustrating the operation of each valve while a vehicle is in operation.

Next, the refueling determination process for forming the determination whether or not fuel is being supplied into the fuel tank 7 will be described referring to a detailed process flow chart in FIG. 5. This process is executed with time interruption at a specified time interval (e.g., every 1 second).

When this process starts, in Step 110, a determination is made whether or not a timer (described later) has elapsed a specified time period, wherein the specified time period is supposed to have some allowance in addition to the time required for normal refueling. When the determination is negative, the process proceeds to Step 120. In Step 120, a determination is made whether or not the vehicle speed is "0." When the determination is positive, the process proceeds to Step 130. In Step 130, a determination is made whether or not the refueling state has been detected by the refueling detection switch 18. When the determination is positive, the process proceeds to Step 140. In Step 140, a determination is made whether or not the refueling flag XFU is "1." When the determination is positive, it is judged that fuel is being supplied into the fuel tank 7, and this process is terminated without taking any further step. When the determination is negative, the process proceeds to Step 150. In Step 150, the timer is started, and in Step 160, it is the refueling flag XFU is set to "1" which indicates that refueling has been started, and this process is terminated.

When the determination is positive in Step 110, the timer is reset in Step 170, and the process proceeds to Step 180. In Step 180, the refueling flag XFU is set to "0" which indicates that fuel is not being supplied into the fuel tank 7, and this process is terminated. Even when the determination is negative in Steps 120 and 130, the process proceeds to Step 180, and the refueling flag XFU is set to "0," and this process is terminated.

In this process, even if the refueling detection switch 18 erroneously detects the refueling when fuel is not being supplied actually into the fuel tank 7, the refuelling flag XFU is forcedly set to "0" when the specified time has elapsed or when the vehicle speed is not "0." Therefore, the control of the power supply to the coil 221 of the solenoid 220 can more accurately be executed.

The conditions of the opening/closing of the purge valve 16, constant pressure operating valve 210 and differential pressure operating valve 211 and the energization/deenergization condition of the solenoid 220, in the case of the above processing by ECU 24, will be described referring to time charts in FIGS. 6A through 6E.

When the vehicle is in operation ($t_0$–$t_1$ and $t_2$–$t_3$), the negative pressure within the intake pipe 2 is introduced into the canister 11 through the purge valve 16. As a result, the pressure within the canister 11 decreases to be lower than the atmospheric pressure "0" by a specified value (150 mmAq in this embodiment) or more. For this reason, the differential pressure operating valve 211 of the atmospheric escape valve 21 opens, and the atmosphere is introduced into the canister 11. Then, the atmosphere introduced into the canister 11 flows into the intake pipe 2 having lower absolute pressure.

When the refueling starts at the time $t_1$, the purge valve 16 closes and the power supply to the coil 221 of the solenoid 220 starts, and the constant pressure operating valve 210 of the atmospheric escape valve 21 is forcedly opened and controlled during the refueling. At this time, as the in-tank pressure increases, air flows from the fuel tank 7 toward the canister 11. Fuel evaporation gas generated during the refueling is conveyed to the canister 11 on this air flow. On the other hand, within the canister 11, air flows from the introduction opening 23 to the atmospheric escape valve 21 by detouring the partition 22 and further from the atmospheric scape valve 21 into the atmosphere. The fuel evaporation gas also flows toward the atmospheric escape valve 21 on this air flow, but is adsorbed to the adsorbent 20 on the way and no fuel evaporation gas can flow out into the atmosphere. When refueling is terminated at the time $t_2$, power supply to the coil 221 of the solenoid 220 is stopped, and consequently the first communication passage 206 closes.

In this embodiment, as the atmospheric escape valve 21 is disposed on the side opposite to the introduction opening 23 across the partition 22, the above air flow is generated during the refueling and this air flow carries a large quantity of fuel evaporation gas generated during the refueling can efficiently be adsorbed by the adsorbent.

After the engine 1 stops ($t_3$ and thereafter), as the power supply to the coil 221 of the solenoid 220 is stopped, the opening/closing of the atmospheric escape valve 21 is performed only by the differential pressure between the inner pressure of the canister 11 and the atmospheric pressure. Furthermore, immediately after the engine 1 stops, as the temperature around the fuel tank 7 is high, fuel evaporation gas generates, and consequently the pressure within the canister 11 communicated with the fuel tank 7 is high. Therefore, when the differential pressure between the inner pressure of the canister 11 and the atmospheric pressure is equal to or larger than a specified value (250 mmAq in this embodiment), the first communication passage 206 opens, and the fuel evaporation gas generated after the engine 1 stops is conveyed on the above air flow and adsorbed to the adsorbent 20. In this manner, by maintaining the in-tank pressure to an appropriately high level while the vehicle is at a stop, the quantity of the fuel evaporation gas generating while the vehicle is at a stop can be controlled.

Described next is a leak checking method by which a determination is made whether or not there is any leak from the fuel evaporation gas passage composed of the fuel tank 7, the canister 11, the communication pipe 12, the purge pipe 15, the purge valve 16 and the atmospheric escape valve 21.

In this embodiment, the leak check is performed in accordance with process flow charts in FIGS. 7 to 11. The description will refer to these flow charts. Incidentally, this process is performed every 1 second.

Figure 7:
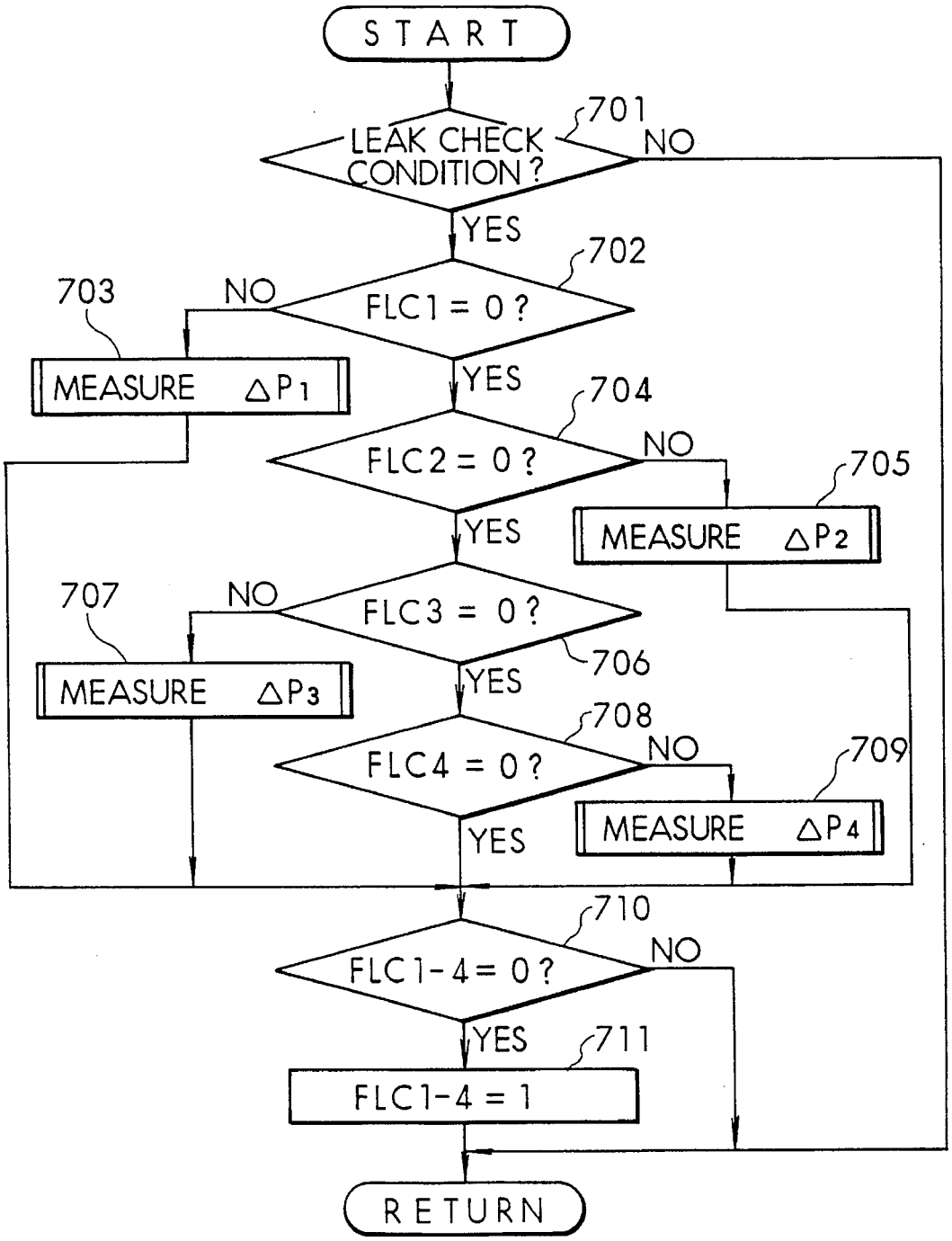
FIG. 7 is a process flow chart illustrating a leak checking process performed by the ECU.

When this process starts, in Step 701 illustrated in FIG. 7, a determination is made whether or not leak checking conditions have been satisfied. Here, the leak checking conditions includes that (1) the vehicle is in an idling operation and (2) the variation in the vehicle speed is within 2 km/h, for example. If these leak checking conditions have not been satisfied here, this process is terminated without taking any further step. If these leak checking conditions have been satisfied, the leak checking is performed in Step 702 and thereafter. In Step 207, a determination is made whether or not a first leak checking flag FLC1 is "0." Here, the first leak checking flag FLC1 is "0" when the variation $\Delta P_1$ in the in-tank pressure is not measured, and "1" when the variation $\Delta P_1$ in the pressure within the fuel tank 7 is measured. Therefore, when the determination here is positive, i.e., it is judged that the variation $\Delta P_1$ in the in-tank pressure is not measured, and the process proceeds to Step 704. When the determination is negative, the process proceeds to Step 703 to perform the measurement of the variation $\Delta P_1$.

Figure 8:
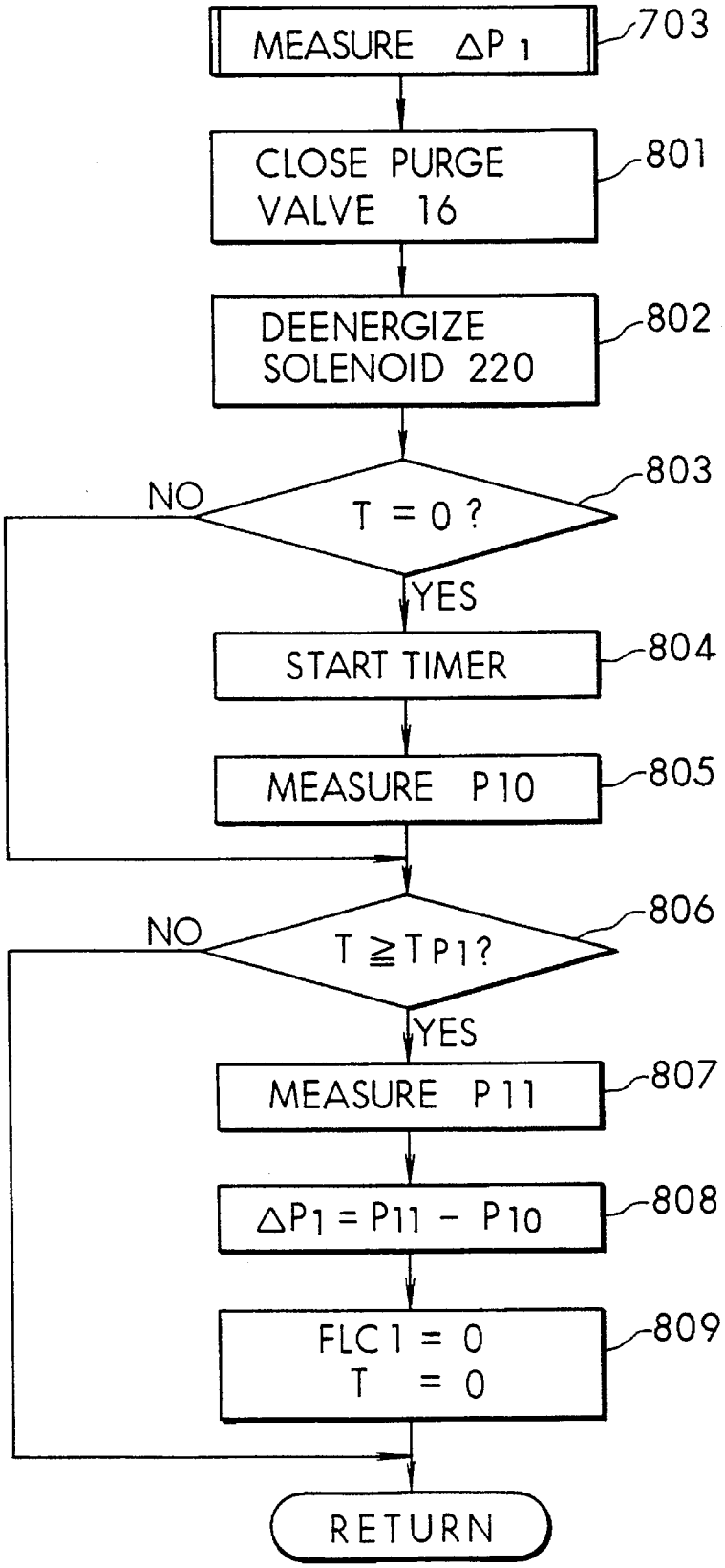
FIG. 8 is a process flow chart illustrating the leak checking process performed by the ECU.

In Step 703, the process illustrated in FIG. 8 is performed, and the variation $\Delta P_1$ is measured. Now, the description will be made to the process flow chart in FIG. 8.

When this process starts, in Step 801, the purge valve 16 is closed. Then, in Step 802., the power supply to the coil 221 of the solenoid 220 is stopped (or left in the stopped condition). In Step 803, a judgement is made whether or not the timer value is "0." When the timer value is "0," the process proceeds to Step 804 to start the timer. When the timer is started in Step 804, the then pressure $P_{10}$ within the fuel tank 7 is measured in Step 805, and the process proceeds to Step 806. When the determination is negative in Step 803, the process proceeds to Step 806.

In step 806, a determination is made whether or not the timer value T is equal to or larger than a specified value $T_{P1}$ (10 seconds in this embodiment). When the determination is negative, the process terminates without taking any further steps, and when the determination is positive, the process proceeds to Step 807. In Step 807, the then pressure $P_{11}$ within the fuel tank 7 is measured again. In Step 808, a difference between the pressure $P_{10}$ when the timer value detected in Step 805 is "0" and the pressure $P_{11}$ within the fuel tank 7 when the timer value detected here is "0" is calculated, and this difference $\Delta P_1$ is calculated as $\Delta P_1=P_{11}-P_{10}$. Furthermore, in Step 809, the flag FLC1 and the timer value T are reset to terminate this process, and the process proceeds to Step 710 in FIG. 7.

In Step 704, a determination is made whether or not a second leak checking flag FLC2 is "0." Here, the second leak checking flag FLC2 is "0" when a second variation $\Delta P_2$ in the in-tank pressure (described herein later) is not measured, and "1" when the variation $\Delta P_2$ in the in-tank pressure is measured. Therefore, when the determination here is positive, i.e., it is judged that the second variation $\Delta P_2$ in the in-tank pressure is not measured, and the process proceeds to Step 706. When the determination is negative, the process proceeds to Step 705 to perform the measurement of the variation $\Delta P_2$.

Figure 9:
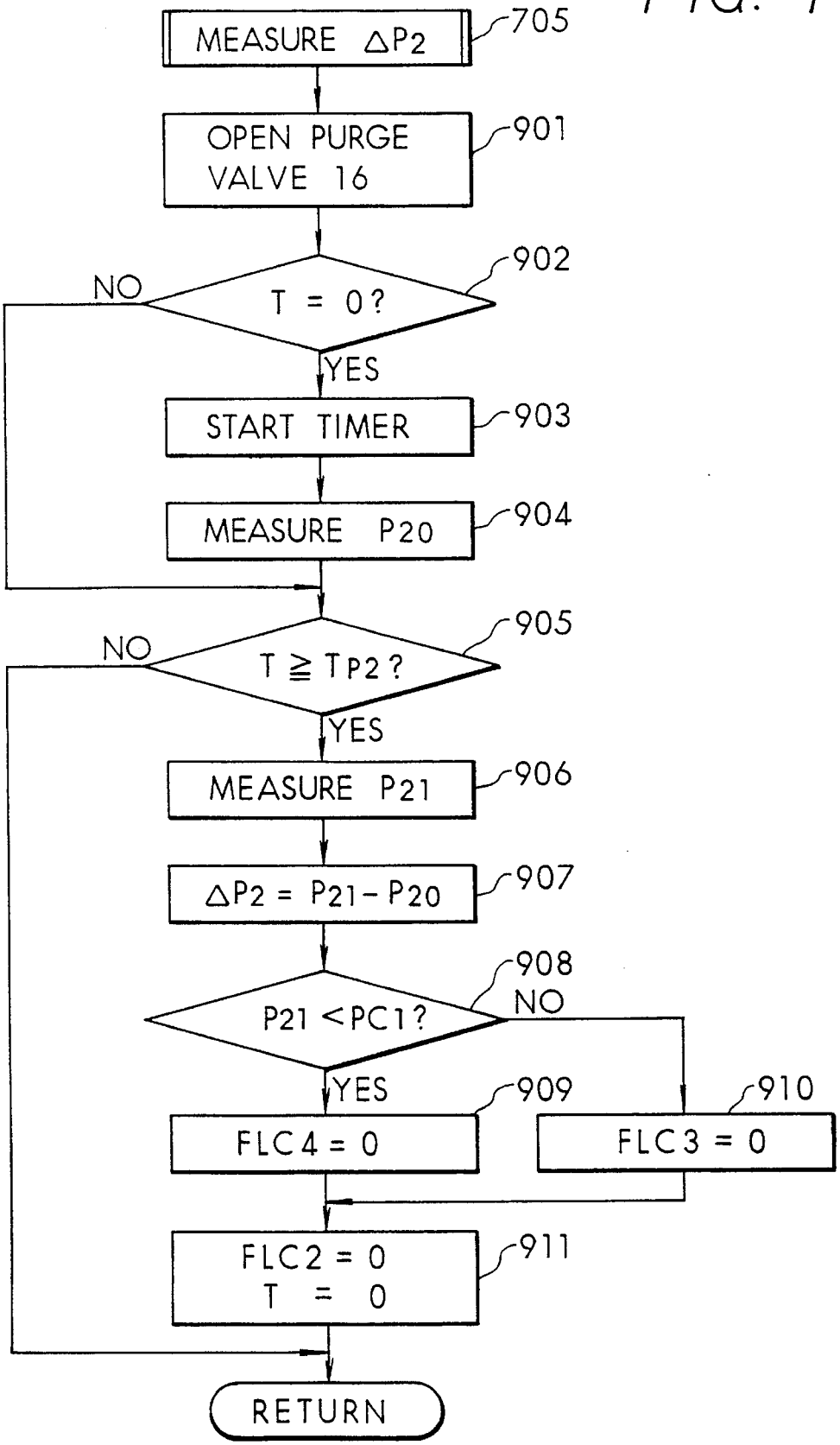
FIG. 9 is a process flow chart illustrating the leak checking process performed by the ECU.

In Step 705, the process illustrated in FIG. 9 is performed, and the variation $\Delta P_2$ is measured. When this process starts, in Step 901, the purge valve 16 is opened. Then, in Step 902, a determination is made whether or not the timer value T is "0." When the timer value T is "0," the process proceeds to Step 903. In Step 903, the timer is started, and the process proceeds to Step 904. In Step 904, the then pressure $P_{20}$ within the fuel tank 7 is measured, and the process proceeds to Step 905. When the determination in Step 902 is negative, the process proceeds to Step 905 without taking any further step.

In Step 905, a determination is made whether or not the timer value T is equal to or larger than a specified value $T_{P2}$ (e.g., 60 seconds in this embodiment). When the timer value T is equal to or larger than the specified value $T_{P2}$, the process proceeds to Step 906. When the timer value is smaller than the specified value $T_{P2}$, this process is terminated without taking any further steps. In Step 906, the then pressure $P_{21}$ within the fuel tank 7 is measured. In Step 907, a difference between the pressure $P_{21}$ when the timer value T exceeds the specified value $T_{P2}$ and the pressure $P_{20}$ within the fuel tank 7 when the timer value T is "0" is calculated, and this difference $\Delta P_2$ is calculated as $\Delta P_2=P_{21}-P_{20}$. Furthermore, in Step 908, a determination is made whether or not the value of $P_{21}$ is smaller than the specified value $PC_1$ (e.g., −150 mmAq). Here, when the determination is positive, the process proceeds to Step 909. In Step 909, a fourth leak checking flag FLC4 is set to "0," and the process proceeds to Step 911. In Step 911, when the determination is negative, the process proceeds to Step 910. In Step 910, a third leak checking flag FLC3 is set to "0," and the process proceeds to Step 911. In Step 911, the second leak checking flag FLC2 and the timer are reset to terminate this process, and the process proceeds to Step 710 in FIG. 7.

In Step 706, a determination is made whether or not a third leak checking flag FLC3 is "0." Here, the third leak checking flag FLC3 is "0" when the third variation $\Delta P_3$ in the in-tank pressure (described later) is not measured, and "1" when the third variation $\Delta P_3$ in the pressure within the fuel tank 7 is measured. Therefore, when the determination here is positive, i.e., it is judged that the third variation $\Delta P_3$ in the in-tank pressure is not measured, and the process proceeds to Step 708. When the determination is negative, the process proceeds to Step 707 to perform the measurement of the variation $\Delta P_3$.

Figure 10:
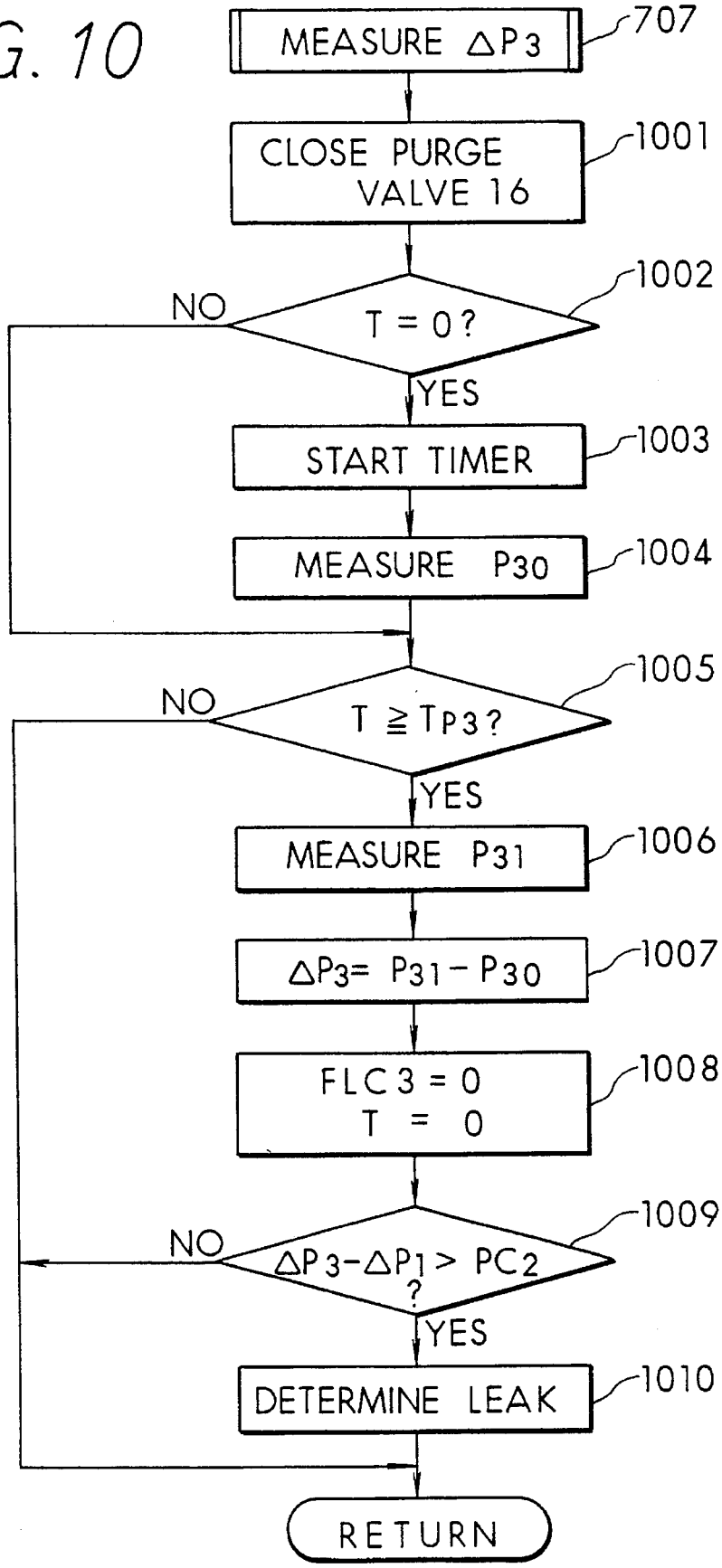
FIG. 10 is a process flow chart illustrating the leak checking process performed by the ECU.

In Step 707, the process illustrated in FIG. 10 is performed, and the variation $\Delta P_3$ is measured.

When this process starts, in Step 1001, the purge valve 16 is closed. Then, in Step 1002, a determination is made whether or not the timer value T is "0." When the determination is positive, the process proceeds to Step 1003. In Step 1003, the timer is started, and the process proceeds to Step 1004. In Step 1004, the then pressure $P_{30}$ within the fuel tank 7 is measured, and the process proceeds to Step 1005. When the determination in Step 1002 is negative, the process proceeds to Step 1005 without taking any further step.

In Step 1005, a determination is made whether or not the timer value T is equal to or larger than a specified value $T_{P3}$ (e.g., 10 seconds in this embodiment). When the determination is negative, this process is terminated, and the process proceeds to Step 710 in FIG. 7. When the determination is positive, the process proceeds to Step 1006 and the pressure $P_{31}$ within the fuel tank 7 is measured, and the process proceeds to Step 1007. In Step 1007, a difference between the pressure $P_{31}$ when the timer value T exceeds the specified value $T_{P3}$ and the pressure $P_{30}$ within the fuel tank 7 when the timer value is "0" is calculated, and this difference $\Delta P_3$ is calculated as $\Delta P_3=P_{31}-P_{30}$. Furthermore, in Step 1008, a difference between $\Delta P_3$ and $\Delta P_1$ calculated in the process flow chart in FIG. 8 is calculated, and a determination is made whether or not the difference value is larger than the specified value $PC_2$ (e.g., 50 mmAq ). Here, when the determination is negative, this process is terminated, and the process proceeds to Step 710 in FIG. 7. When the determination is positive, it is judged that there is a leak in Step 1010, and this process is terminated.

In Step 708, a determination is made whether or not fourth leak checking flag FLC4 is set to "0." Here, the fourth leak checking flag FLC4 is "0" when a fourth variation $\Delta P_4$ in the pressure within the tank (described later) is not measured, and "1" when the fourth variation $\Delta P_4$ in the in-tank pressure is measured. Therefore, when the determination is positive, it is judged that $\Delta P_4$ is not measured, and the process proceeds to Step 710. When the determination is negative, the process proceeds to Step 709 to measure $\Delta P_4$.

Figure 11:
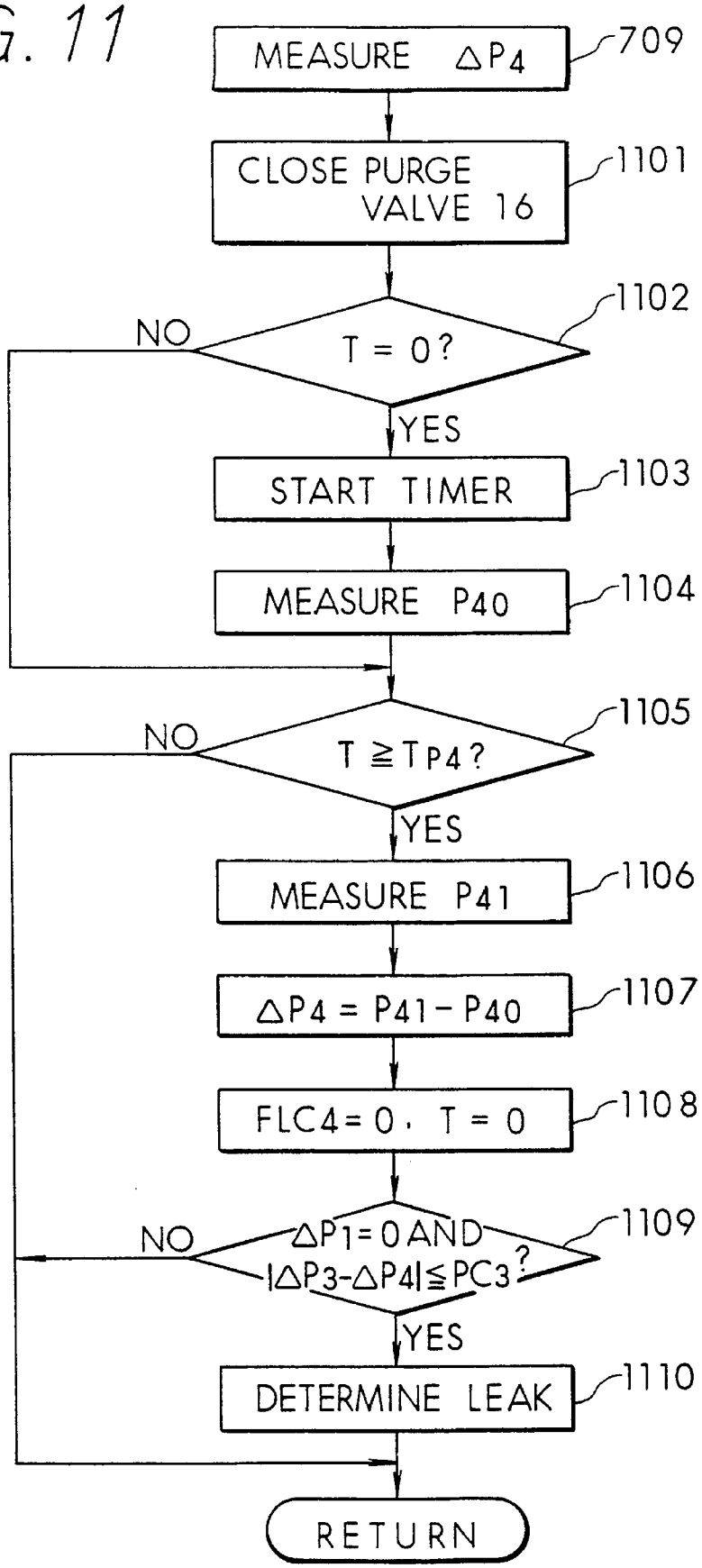
FIG. 11 is a process flow chart illustrating the leak checking process performed by the ECU.

In Step 709, steps illustrated in FIG. 11 are taken to measure $\Delta P_4$.

When this process starts, in Step 1101, the purge valve 16 is closed. Then, in Step 1102, a determination is made whether or not the timer value T is "0." When the determination is positive, the process proceeds to Step 1103. In Step 1103, the timer is started, and the process proceeds to Step 1104. In Step 1104, the then pressure $P_{40}$ within the fuel tank 7 is measured, and the process proceeds to Step 1105. When the determination in Step 1102 is negative, the process proceeds to Step 1105 without taking any further step.

In Step 1105, a determination is made whether or not the timer value T is equal to or larger than a specified value $T_{P4}$ (e.g., 10 seconds in this embodiment). When the determination is negative, this process is terminated, and the process proceeds to Step 710 in FIG. 7. When the determination is positive, the process proceeds to Step 1106 and the pressure $P_{41}$ within the fuel tank 7 is measured, and the process proceeds to Step 1107. In Step 1107, a difference between the pressure $P_{41}$ when the timer value is the specified value $T_{P4}$ and the in-tank pressure $P_{40}$ when the timer value T is "0" is calculated, and this difference $\Delta P_4$ is calculated as $\Delta P_4=P_{41}-P_{40}$.

In Step 1108, a determination is made whether or not $\Delta P_1$ calculated in the process flow chart illustrated in FIG. 8 is "0" and the following equation is satisfied.

$$|\Delta P_3 - \Delta P_4| \leqq PC_3$$

Here, the value of $PC_3$ in this embodiment is 25 mmAq. When the determination is negative, this process is terminated, and the process proceeds to Step 710 in FIG. 7. When the determination is positive, it is judged that there is a leak in Step 1110, and then this process is terminated.

In Step 710 in FIG. 7, a determination is made whether or not all the leak checking flags FLC1 to FLC4 are "0." When the determination is positive, it is judged that the leak checking has been completed, and the process proceeds to Step 711, and set all the leak checking flags FLC1 to FLC4 to "1" in preparation for the next leak checking. When the determination is negative, this process is terminated without taking any further steps.

Next, the opening/closing conditions of the purge valve 16 and atmospheric escape valve 21 and the variation in the differential pressure between the in-tank pressure and the atmospheric pressure (the detected value of the in-tank pressure sensor 19) in the case of performing the above checking operation are described with reference to time charts in FIGS. 12A through 12D.

Figure 12A:
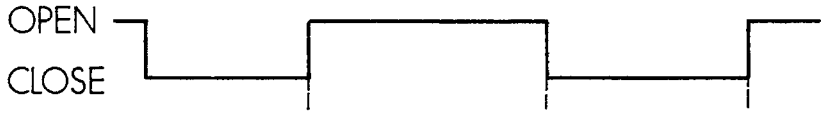
FIGS. 12A through 12D are time charts when the leak checking process is performed.
Figure 12B:
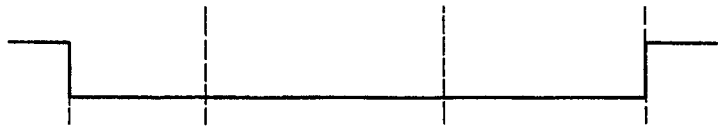
Figure 12C:
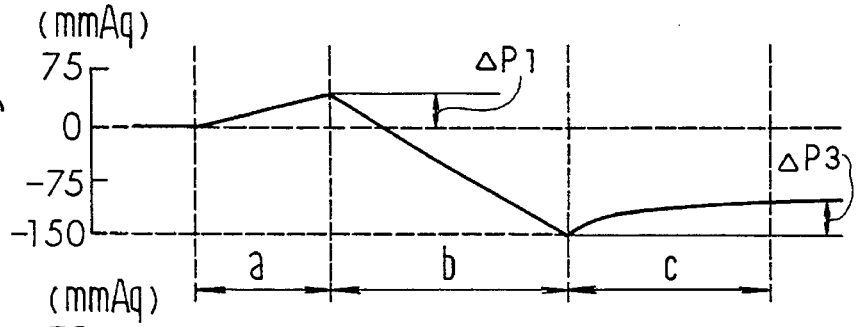

When the leak checking process is started, the purge valve 16 is closed for the specified time period "a" to measure $\Delta P_1$ as shown in time chart of FIG. 12A. When there is no leak, the in-tank pressure increases according to the quantity of the fuel evaporation gas generating within the fuel tank 7. This pressure increase corresponds to $\Delta P_1$ as shown in FIG. 12C.

Then, the purge valve 16 is opened for the period "b", and the negative pressure within the intake pipe 2 is introduced into the canister 11. When a negative pressure of 150 mmAq is introduced from the intake pipe 2 into the canister 11, the purge valve 16 is closed again for the specified time period "c" (10 seconds in this embodiment). At this time, the in-tank pressure increases by $\Delta P_3$ according to the quantity of fuel evaporation gas generation. When there is no leak, the quantity of increase $\Delta P_1$ in the fuel tank 7 when the purge valve 16 is closed for the first time and the quantity of increase $\Delta P_3$ in the in-tank pressure detected this time are almost equal to each other as shown in FIG. 12C.

When there is a leak, even if the purge valve 16 is closed, the in-tank pressure does not increase to be higher than the atmospheric pressure due to the leak. Accordingly, $\Delta P_1$ becomes "0." However, even in the normal operational condition, when there is no leak, as $\Delta P_1$ becomes "0," there is no distinction between the condition with leak.

Nevertheless, when the purge valve 16 is opened and the negative pressure is introduced from the intake pipe 2 into the canister 11, a negative pressure of −150 mmAq can be introduced in the normal operational condition, while the negative pressure can not be introduced even after a specified measurement time period has elapsed (60 seconds in this embodiment) in the condition with leak.

Figure 12D:
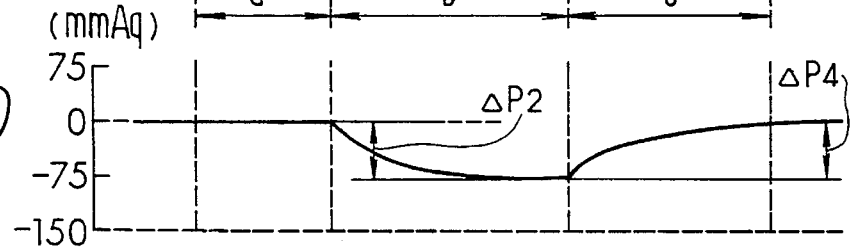

Then, the purge valve 16 is closed, and the quantity of the increase in the in-tank pressure is measured. Here, there is little fuel evaporation gas generation in the normal operational condition, this in-tank pressure increase quantity $\Delta P_4$ is nearly "0." When there is a leak, however, as the atmospheric air is introduced, the in-tank pressure increases as much as the introduced negative pressure. Therefore, even if there is no fuel evaporation gas generation ($\Delta P_1$=0) as shown in FIG. 12D, when the pressure variation $\Delta P_2$ when the negative pressure is introduced and the pressure variation $\Delta P_4$ when the purge valve 16 is closed after the negative pressure is introduced are almost equal to each other, it can be determined that there is a leak.

As described above, according to the construction of the first embodiment of the present invention, as the inside diameter of the communication pipe 12 is set to be rather large, a sufficient quantity of fuel evaporation gas can be sent into the canister 11 during the refueling. Furthermore, the quantity of the fuel evaporation gas to be sent from the fuel tank 7 into the canister is regulated by the atmospheric escape valve 21 within the canister 11, there is no need to provide a valve within the communication pipe 12. Moreover, as a valve for regulating the quantity of the fuel evaporation gas send from the fuel tank 7 into the canister 11, atmospheric escape valve 21 is provided within the canister 11, the degradation in the valve due to the fuel evaporation gas can be controlled.

In addition, in the first embodiment, when the in-tank pressure exceeds the atmospheric pressure to the specified pressure level while the vehicle is at a stop, pressure is released through the first communication passage 206. This arrangement can prevent the deformation of the outer wall of the fuel tank 7 due to excessive rise of the in-tank pressure. Furthermore, the in-tank pressure can be maintained at a high pressure level until the specified pressure is obtained, the generation of fuel evaporation gas while the vehicle is at a stop can be suppressed.

Still furthermore, as the canister 11 is provided with the partition 22 and the introduction opening 23 from the fuel tank 7 and the atmospheric escape valve 21 are provided across this partition 22, there is a fluid flow from the introduction opening 3 to the atmospheric escape valve 21 as described above. Therefore, the canister 11 can efficiently be used during the refueling.

In the first embodiment, the atmospheric escape valve 21 and Steps 300 and 400 correspond to the valve unit and the functions thereof accordingly, and Steps 110 to 180 correspond to the refueling determination means and the functions thereof accordingly.

The second embodiment will now be described.

Figure 13:
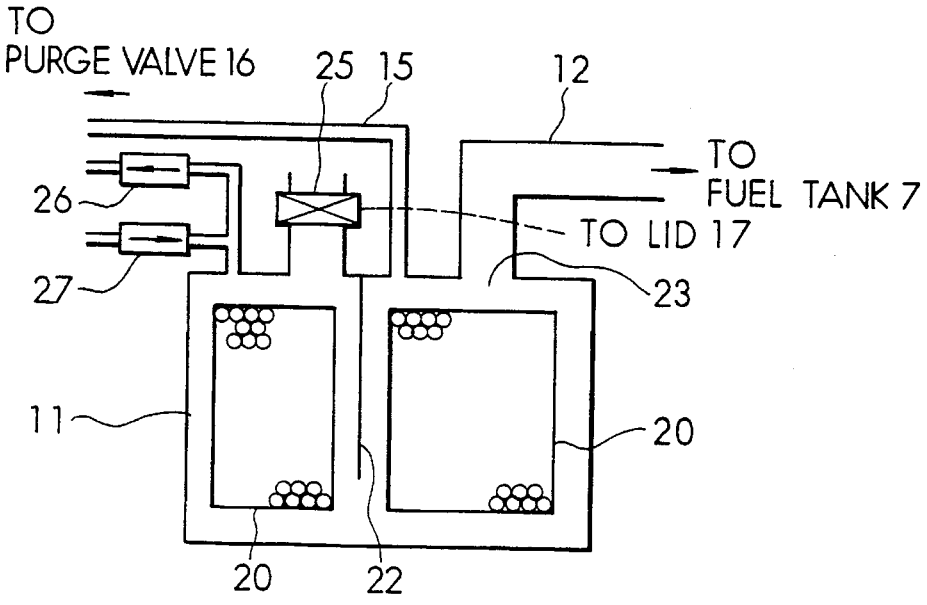
FIG. 13 is a schematic constructional view illustrating a canister used in a second embodiment.

In the second embodiment, instead of the canister 11 according to the first embodiment, a canister illustrated in FIG. 13 is employed. In the following description of the construction and operation of the canister according to the second embodiment, emphasis will be placed on differences from the canister according to the first embodiment. For those construction parts of the canister similar to those of the canister according to the first embodiment, the same reference numerals are used.

In the second embodiment, instead of the atmospheric escape valve 21, an open valve 25, a pressure control valve 26 and an atmospheric introduction valve 27 are employed.

The open valve 25 is mechanically linked with the fuel filler lid 17 through a link mechanism (not illustrated). Accordingly, in construction, when the fuel filler lid 17 is opened, the open valve 25 is also opened, and the when the fuel filler lid 17 is closed, the open valve 25 is also closed. In this construction, the open valve 25 is opened only during the refueling.

When the pressure within the fuel tank 7, i.e., the pressure within the canister 11, is higher than the atmospheric pressure, the pressure control valve 26 releases the pressure to the outside. When the pressure within the canister 11 is lower than the atmospheric pressure by a specified value, the atmospheric introduction valve 27 opens and introduces the atmosphere into the canister 11.

By using the canister 11 equipped with the above valves, while the vehicle is in operation, when the purge valve 16 is controlled to open and the negative pressure is introduced into the canister 11, the atmospheric introduction valve 27 opens and introduces the atmosphere into the canister 11. The introduced fresh air purges the fuel evaporation gas adsorbed to the adsorbent 20 toward the intake pipe 2 having a lower absolute pressure.

On the other hand, during the refueling, as the open valve 25 opens, the fuel evaporation gas generated within the fuel tank 7 is introduced into the canister 11 and adsorbed to the adsorbent 20 as described in the first embodiment.

Then, while the vehicle is at a stop, when the pressure within the fuel tank 7 exceeds a specified pressure, as the pressure control valve 26 opens, further increase in the pressure can be controlled. Furthermore, as the pressure within the fuel tank 7 can be maintained at a comparatively high set pressure, the fuel evaporation gas generation while the vehicle is at a stop can be controlled.

As described above, even when the construction of the second embodiment is employed, the same effect as that achieved by the first embodiment can be achieved as well. Moreover, by employing the open valve 25 which mechanically operates according to the refueling condition, the valve control by the ECU 24 illustrated in FIGS. 4 and 5 can be omitted.

In the case of this embodiment, as the leak checking method differs from that of the first embodiment, the leak checking method according to the second embodiment will now be described.

Figure 14:
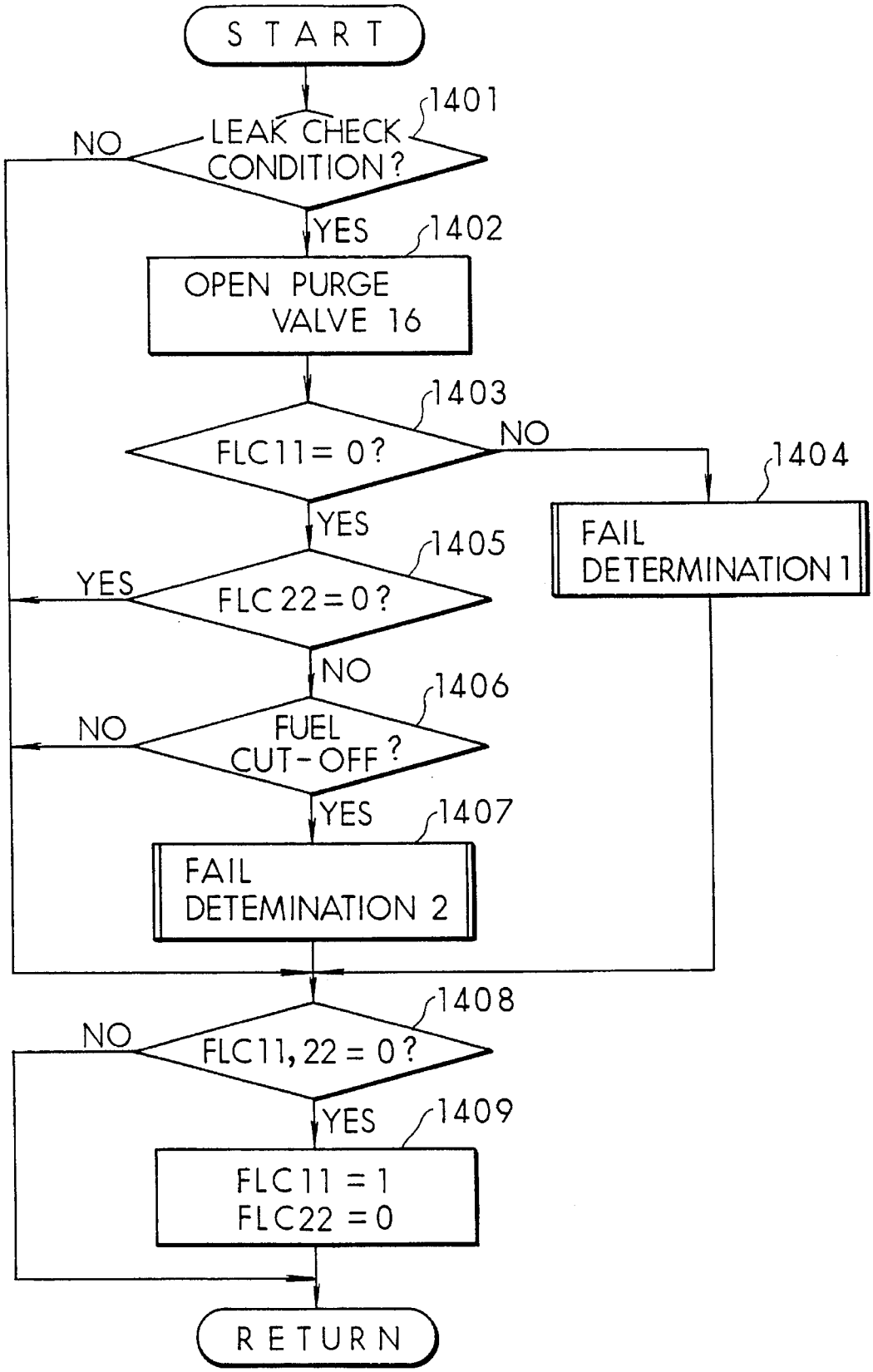
FIG. 14 is a process flow chart illustrating a leak checking process performed by the ECU.
Figure 15:
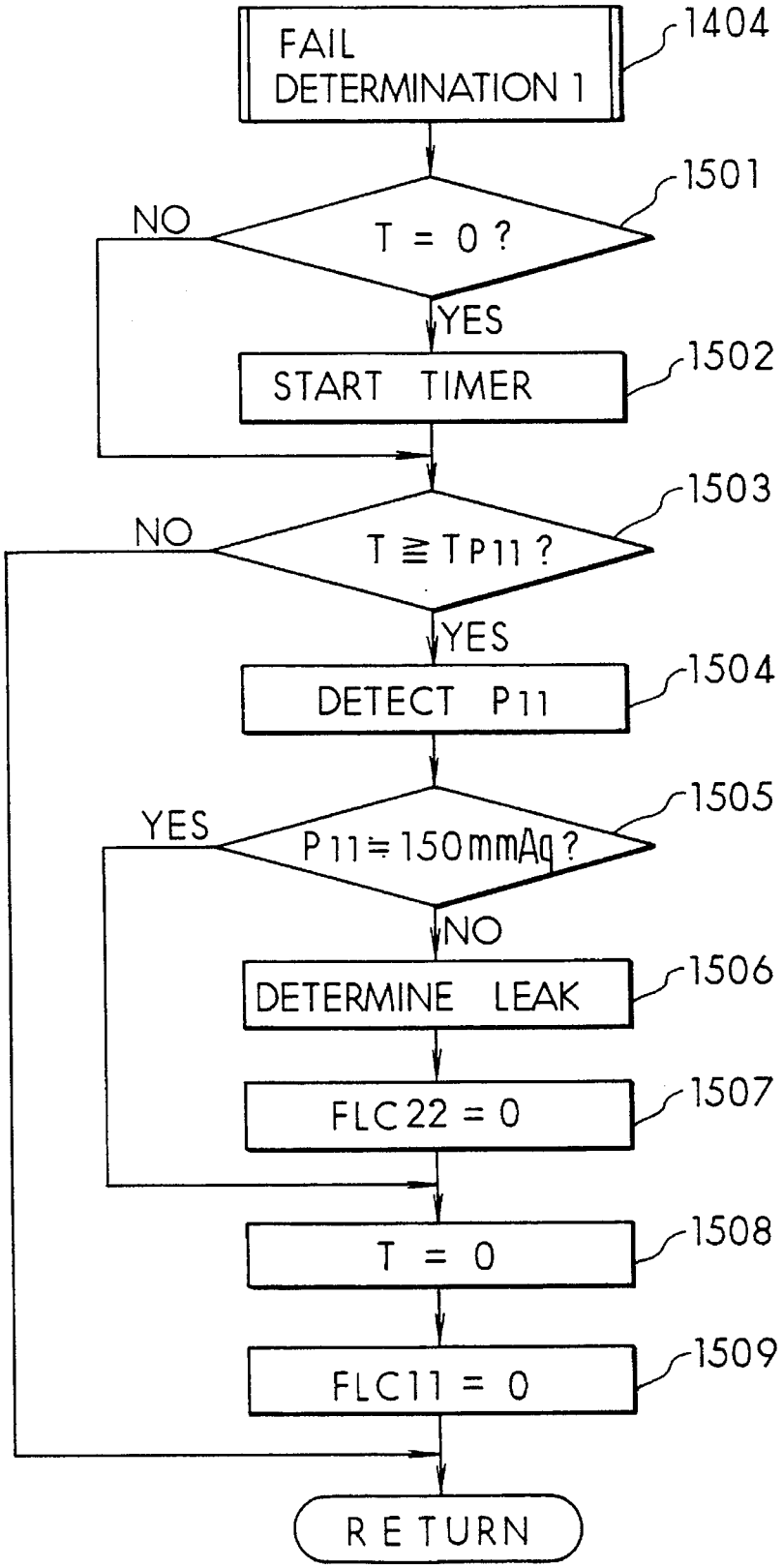
FIG. 15 is a process flow chart illustrating the leak checking process performed by the ECU.
Figure 16:
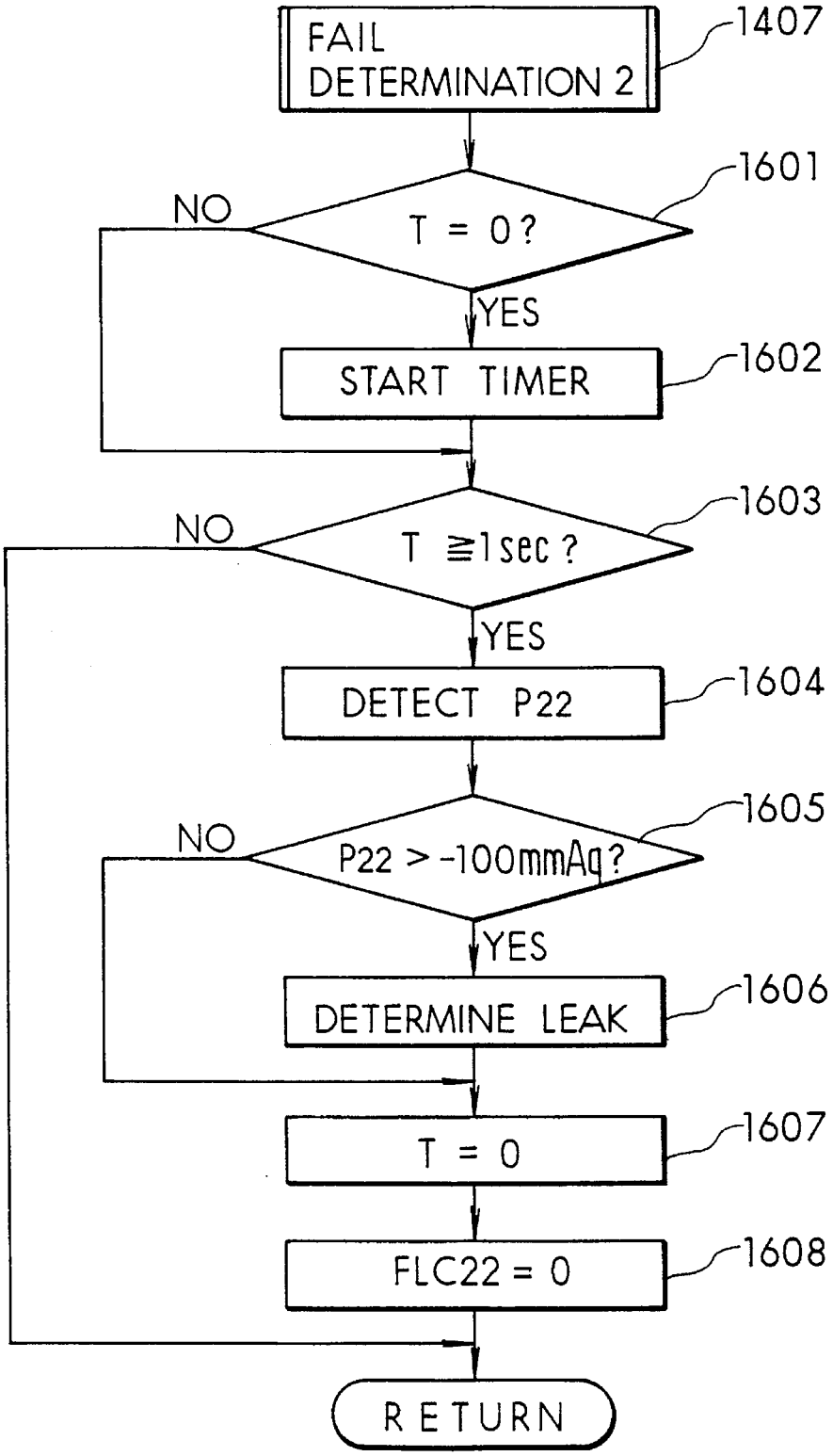
FIG. 16 is a process flow chart illustrating the leak checking process performed by the ECU.

FIGS. 14 to 16 are the leak checking process flow charts performed by the ECU 24.

When the process illustrated in FIG. 14 is started, in Step 1401, a determination is made whether or not a leak checking condition has been satisfied. Here, the leak checking condition means that the purge is being performed at a speed faster than a specified vehicle speed. If this condition has not been satisfied, the process proceeds to Step 1408. When this condition has been satisfied, the process proceeds to Step 1402. In Step 1402, the purge valve 16 is controlled to open, and the process proceeds to Step 1403. In Step 1403, a determination is made whether or not a fifth leak checking flag FLC11 is "0." Here, the fifth leak checking flag FLC11 is "1" when the process of Step 1404 (described later) is performed, and "0" when the process of Step 1404 is not performed. Therefore, when the determination is positive, as the process of Step 1404 is not performed, the process proceeds to Step 1405. When the determination is negative, the process proceeds to Step 1404, and a fail determination process 1 is performed.

FIG. 15 is a process flow chart illustrating the fail determination process 1 of Step 1404. When this process is started, in Step 1501, a determination is made whether or not the timer value T is "0." When the determination is positive, in Step 1502, the timer is started, and the process proceeds to Step 1503. When the determination is negative in Step 1501, the process proceeds to Step 1504. In Step 1503, a determination is made whether or not the timer value T is larger than a specified value $TP_{11}$ (1 minutes in this embodiment). When the determination is negative, the process is terminated without taking any further step. When the determination is positive, the leak determination is performed in Steps 1504 to 1507.

In Step 1504, the then in-tank pressure $P_{11}$ is detected. In Step 1505, a determination is made whether or not the in-tank pressure $P_{11}$ is almost equal to the set pressure of the atmospheric introduction valve 27 (−150 mmAq). When the determination is positive, the process proceeds to Step 1508. When the determination is negative, the process proceeds to Step 1506. In Step 1506, it is judged that there is a leak. Then, in Step 1507, a sixth leak checking flag FLC22 is set to "0" so that the processes of Steps 1406 and 1407 (described herein later) can be omitted, and then the process proceeds to Step 1508. In Step 1508, the timer is reset. Furthermore, in Step 1509, the fifth leak checking flag FLC11 is reset to terminate this process, and the process proceeds to Step 1408 in FIG. 14.

When the determination is positive in Step 1403 and the process proceeds to Step 1405, a determination is made whether or not the sixth leak checking flag FLC22 is "0." When the determination is positive, it is judged that there is no need to perform the processes of Steps 1406 and 1407, and the process proceeds to Step 1408. When the determination is negative, the process proceeds to Step 1406. In Step 1406, a determination is made whether or not the fuel is being cut off. When the fuel is not being cut off, the process proceeds to Step 1408, and the process of Step 1407 is not performed. When the fuel is being cut off, the process proceeds to Step 1407, and a fail determination process 2 is performed.

FIG. 16 is the process flow chart of Step 1407 which is the fail determination process 2. When this process is started, in Step 1601, a determination is made whether or not the timer value T is "0." When the determination is positive, the process proceeds to Step 1602. In Step 1602, the timer is started, and the process proceeds to Step 1603. When the determination is negative in Step 1601, the process proceeds to Step 1603 without taking any further step. In Step 1603, a determination is made whether or not the timer value T has elapsed 1 second or more. When the determination is negative, this process is terminated without taking any further steps. When the determination is positive, the process proceeds to Step 1604. In Step 1604, the in-tank pressure $P_{22}$ is detected. In Step 1605, a determination is made whether or not the in-tank pressure $P_{22}$ is larger than a specified value (−100 mmAq). When the determination is positive, it is judged that there is a leak, and then the process proceeds to Step 1607. When the determination is negative, the process proceeds to Step 1607 without taking any further step. In Step 1607, the timer value is reset. In Step 1608, the sixth leak checking flag FLC22 is set to "0," this process is terminated, and the process proceeds to Step 1408 in FIG. 14.

In Step 1408 in FIG. 14, a determination is made whether or not both the fifth and sixth leak checking flags FLC11 and FLC22 are "0." When both the fifth and sixth leak checking flags FLC11 and FLC22 are "0," it is judged that the leak checking process has been completed, and the process proceeds to Step 1409. In Step 1409, both the leak checking flags FLC11 and FLC22 are set to "1" in preparation for the next leak checking process, then this process is terminated. When the determination is negative, it is judged that the current leak checking process has not yet been completed, and this process is terminated without taking any further step.

Figure 17A:
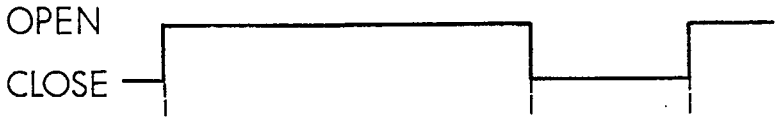
FIGS. 17A through 17C are time charts when the leak checking process is performed.
Figure 17B:
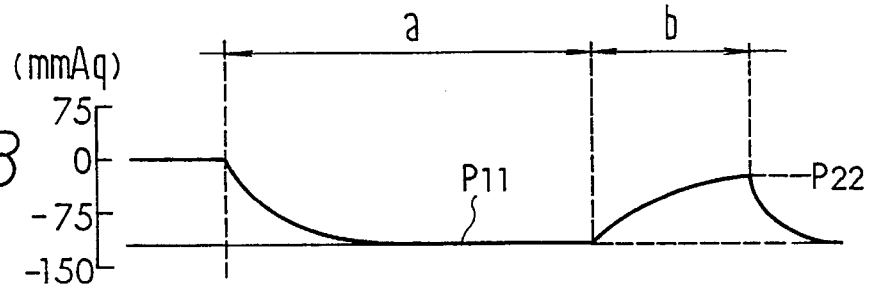

By performing the above process, also in the construction of the second embodiment, leaks can accurately be checked. FIG. 17 is a time chart of the above leak checking. The following description refers to this time chart. When the leak checking is performed, the purge valve 16 is opened (or has been opened) as shown in FIG. 17A. At this time period "a", in the normal operation, the pressure within the canister 11, i.e., the pressure within the fuel tank 7, becomes the set pressure $P_{11}$ of the atmospheric induction valve 27 (a check valve) as shown in FIG. 17B. Therefore, when the in-tank pressure is detected and the detected pressure is not almost the set pressure of the check valve, it can be judged that there is an abnormality.

Figure 17C:
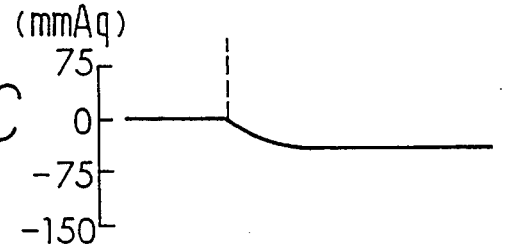

Even if there is a leak, when the quantity of the negative pressure introduction is larger than the quantity of the leak, it is probable that the in-tank pressure is the set pressure of the check valve. Accordingly, by making use of the fact that the purge valve 16 is closed when the fuel is cut off, the in-tank pressure $P_{22}$ after a specified time "b" has elapsed since the purge valve 16 closed is detected, and if the in-tank pressure P22 is larger than the specified value, it can be judged that there is a leak. FIG. 17C shows a time chart of a case where the in-tank pressure is not the set pressure of the check valve even if the purge valve 16 is opened. In this case, it should be judged that there is a leak.

Figure 18:
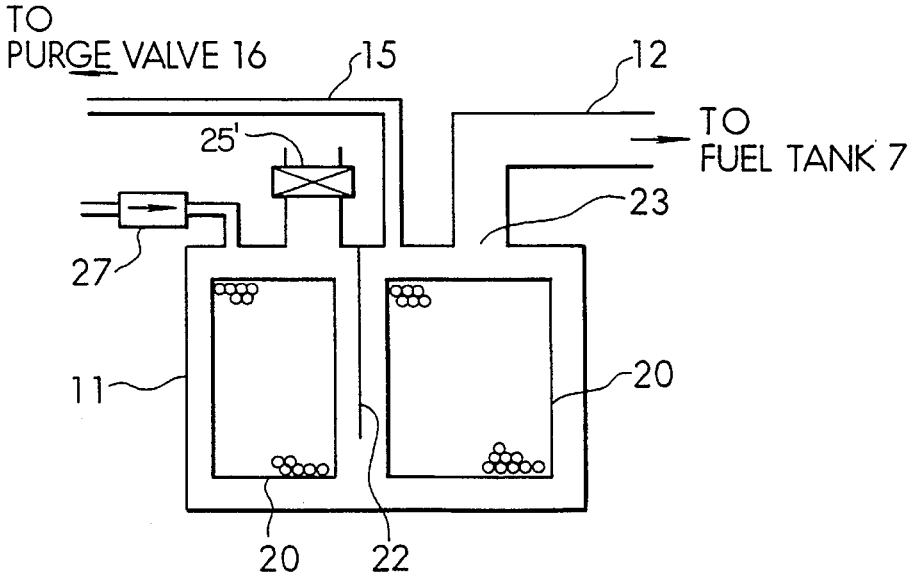
FIG. 18 is a schematic constructional view illustrating the canister used in a modification of the second embodiment.

In the second embodiment, the construction is such that the pressure control valve 26, the atmospheric induction valve 27 and the open valve 25 are provided separately. However, as illustrated in FIG. 18, it is acceptable that the pressure control valve 26 and the open valve 25 are integrated together into a single open valve 25'. In this case, however, the set pressure of the open valve 25' should carefully be set. That is, during the refueling, the open valve 25' should preferably be opened as soon as possible, and for this purpose, the set pressure should be low (e.g., slightly higher than the atmospheric pressure). When the vehicle is at a stop, however, as the in-tank pressure should be maintained at a high level to some degree, the set pressure should be set slightly higher. Therefore, when the pressure control valve 25 of the first embodiment and the open valve 25 are integrated together, it is necessary to set the set pressure so that this requirement can be satisfied as much as possible.

According to the construction of the second embodiment using the present invention, as the open valve 25' is used as a valve which mechanically opens/closes in relation to the refuelling, the construction and control can be simplified.

Next, the third embodiment will be described.

Figure 19:
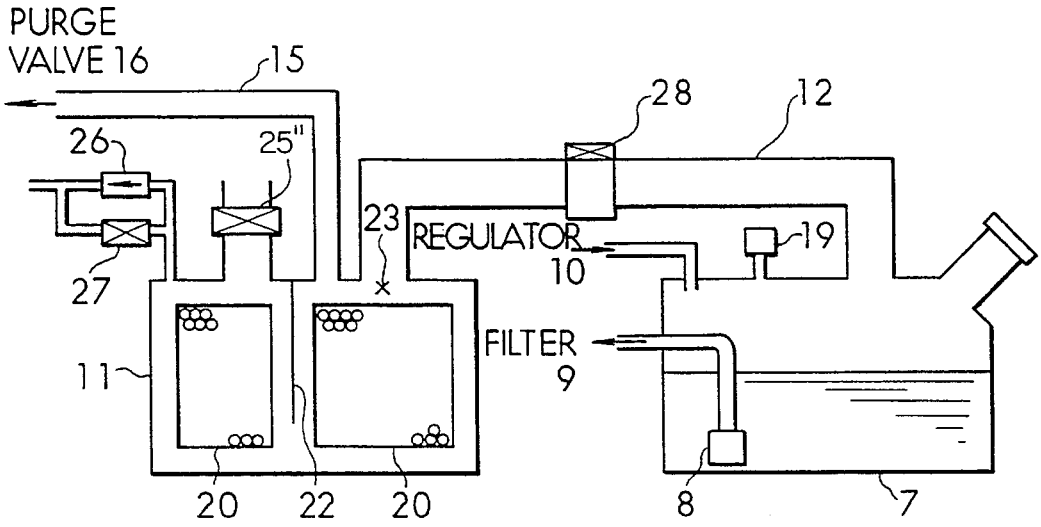
FIG. 19 is a schematic constructional view illustrating a canister used in a third embodiment.

In the third embodiment, as illustrated in FIG. 19, a communication valve 28 is provided within the communication pipe 12 connecting the fuel tank 7 and the canister 11. Although this communication valve 28 is of a similar construction to that of the atmospheric escape valve 21 of the first embodiment, there is a difference between these two embodiments in the piping connecting the joint valve 201 and the joint valve 202 and the set load $S_2$ of the differential pressure operating valve 211. Specifically, in the first embodiment, the joint valve 201 is open to the atmosphere and the joint valve 202 is connected to the canister 11, while in the third embodiment, the joint valve 201 is connected to the communication passage 12 extending to the side of the canister 11 and the joint valve 202 is connected to the communication passage 12 extending to the side of the fuel tank 7. Furthermore, the set load $S_2$ of the differential pressure operating valve 211 should be set to a value which is larger than the atmospheric pressure by a specified value (the pressure higher than the atmospheric pressure by 250 mmAq in this embodiment). That is, this embodiment is of such construction that when the pressure in the canister 11 exceeds the specified value and the pressure within the fuel tank 7 while the vehicle is at a stop, the pressure within the canister 11 can be released into the fuel tank 7. However, in the third embodiment, it is not always necessary to provide the differential pressure operating valve 211, and this valve may be omitted.

Also the third embodiment is, like the second embodiment, of such construction that the open valve 25", the pressure control valve 26 and the atmospheric introduction valve 27 operate like the atmospheric escape valve 21 of the first embodiment. Furthermore, while the open valve 25' of the second embodiment is mechanically operated in the second embodiment, the open valve 25' of the second embodiment is substituted by a solenoid valve 25" controlled by the ECU24. Still furthermore, the atmospheric escape valve 21 is also constructed with a solenoid valve controlled by the ECU24.

In the above construction, the open valve 25" is always closed and power is not supplied to the solenoid of the communication valve 28 while the vehicle is in operation. Therefore, only when the pressure within the fuel tank 7 exceeds the set pressure of the communication valve 28, the pressure within the fuel tank 7 is released into the canister 11.

The purge valve 16 is controlled by the ECU 24, and the opening thereof is set according to the operational condition of the engine 1. The atmospheric introduction valve 27 is also controlled by the ECU 24, and the opening thereof is controlled so that fresh air according to the required purge quantity can be introduced into the canister 11.

During the refueling, the purge valve 16 is controlled to be closed, the open valve 25" is controlled to be opened, and the solenoid of the communication valve 28 is supplied with power and controlled to forcedly be opened. Therefore, the fuel evaporation gas generated within the fuel tank can be introduced into the canister without receiving substantial flow resistance.

While the vehicle is at a stop, the purge valve 16 and the open valve 25" remain closed, and the solenoid of the communication valve 28 is supplied with power. Therefore, unless the pressure within the fuel tank 7 exceeds a specified value, the in-tank pressure can not be released to the side of the canister 11. Due to this arrangement, the set pressure of the communication valve 28 can almost be maintained while the vehicle is at a stop. This set pressure is higher than the atmospheric pressure, and controls the generation of the fuel evaporation gas by increasing the pressure within the fuel tank 7 while the vehicle is at a stop.

Figure 20:
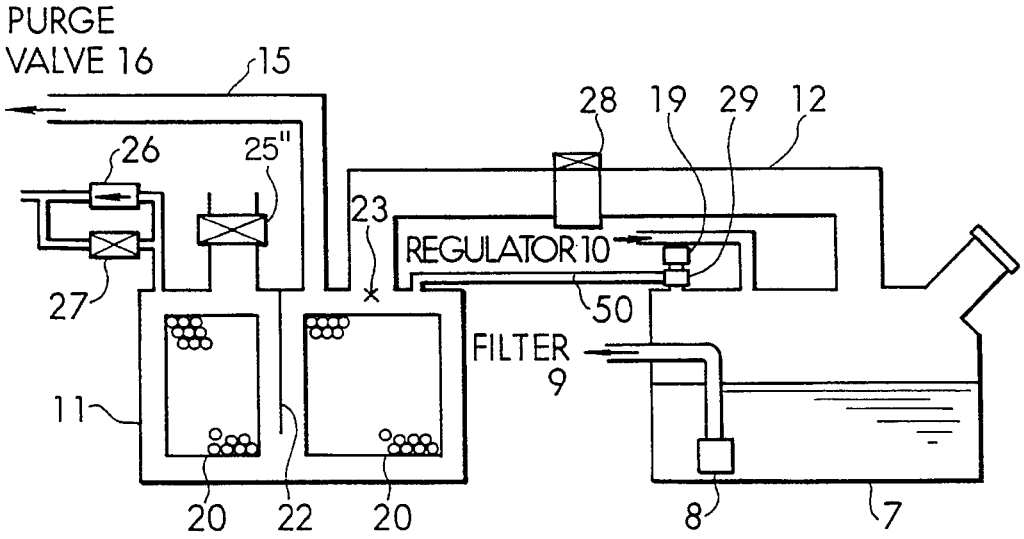
FIG. 20 is a schematic constructional view illustrating a canister used in a modification of the third embodiment.

In the construction of the third embodiment, the communication valve 28 must be controlled to forcedly be opened when leak checking is performed for the reason that the pressure sensor 19 detects only the pressure within the fuel tank 7. However, by modifying the construction as illustrated in FIG. 20, the pressure within the canister 11 and the pressure within the fuel tank 7 can be detected by the pressure sensor 19 alone.

Specifically, a three-way valve 29 is provided within the pipe extending from the fuel tank 7 to the pressure sensor 19, and a pipe 50 is provided to connect this three-way valve 29 to the canister 11. When the leak checking is performed on the side of the canister 11, the three-way valve 29 is switched so as to introduce the pressure within the canister 11 into the pressure sensor 19, and when the leak checking is performed on the side of the fuel tank 7, the three-way valve 29 is switched so as to introduce the pressure within the fuel tank 7 into the pressure sensor 19. As a leak checking method, the method described in the first embodiment can be used. In checking the fuel tank 7 for leak, it is advisable that a determination should be made whether or not the in-tank pressure has increased within a specified time period after the vehicle stopped, for example. If there is no leak, fuel evaporation gas generates within the fuel tank 7, and the intank pressure increases. When there is a leak, however, as the in-tank pressure does not increase to be higher than the atmospheric pressure, the fuel tank 7 can be checked for leak by detecting the in-tank pressure after a specified time has elapsed.

According to the third embodiment using the present invention as described above, by providing the communication valve 28 within the communication pipe 12, the pressure within the fuel tank 7 can be controlled to a specified value higher than the atmospheric pressure even when the vehicle is in operation, and therefore the fuel evaporation gas generation can be controlled. Furthermore, while the vehicle is in operation, as the communication valve 28 remains almost closed, the fuel evaporation gas can hardly flow into the canister 11 from the fuel tank 7. As a result, the fuel evaporation gas quantity within the canister 11 does not sharply increase, and the fuel evaporation gas of constant concentration can be supplied when the intake pipe 2 is purged with fuel evaporation gas through the purge valve 16.

Three embodiments of the present invention have been described. The scope of the present invention is not limited to these three embodiments but, for example, the communication valve 28 may be provided within the communication pipe 12 in the first embodiment like the third embodiment, and furthermore, the communication valve 28 may also be provided within the communication pipe 12 in the second embodiment in the same manner. By employing the above construction, the effect of the third embodiment can be obtained.

Moreover, in the first embodiment, it is acceptable that the differential pressure valve 211 is omitted and, instead thereof, the solenoid 220 is controlled by the ECU 24 according to the operational condition of the vehicle, i.e., the operational condition of the purge valve 16.

Also, in the second embodiment, the atmospheric introduction valve 27 which opens when the in-tank pressure becomes lower than a specified pressure against the atmospheric pressure by using the diaphragm 213. Instead of the atmospheric introduction valve 27, however, a solenoid valve may be used, and the opening thereof may be controlled by the ECU 24. Furthermore, in the second embodiment, the construction and control are simplified by using the open valve 25 which mechanically opens/closes according to the refueling condition. However, it is not always necessary to use the open valve 25 but a solenoid valve may be used instead of the open valve 25 and the opening thereof may be controlled by the ECU24 according to the refueling condition.

In addition, in each embodiment described above, the open valve 25 is provided on a side opposite to the introduction opening 23 across the partition 22. However, it is not always necessary to provide the open valve 25 in this position but the open valve 25 may be provided under the partition 22 facing the introduction opening 23 as seen in prior arts. Nevertheless, if the open valve 25 is provided in this position, as the fuel evaporation gas generated during the refueling flows only through the adsorbent 20 from the introduction opening 23 to the open valve 25, the canister 11 can not sufficiently be used during the refueling.

According to the first aspect of the present invention, the valve unit opens during the refueling and air flows from the fuel tank to the canister. Therefore, the fuel evaporation gas generated within the fuel tank during the refueling flows into the canister and adsorbed to the adsorbent within the canister. Furthermore, while the vehicle is at a stop, when the in-tank pressure becomes higher than the atmospheric pressure, the valve unit opens and the in-tank pressure is released into the atmosphere. That is, as the intank pressure can be maintained at a pressure level higher than the atmospheric pressure, the fuel evaporation gas generation while the vehicle is at a stop can be controlled. Moreover, when the valve unit is provided within the canister, as the valve unit does not bask in the fuel evaporation gas flowing from the fuel tank into the canister, the degradation in the valve unit due to the adherence of fuel thereto can be controlled.

According to the second aspect of the present invention, the function of the valve unit is shared by the open valve, the pressure control valve and the atmospheric introduction valve. In this construction, the type, the maximum flow rate, etc. of the valves can be changed according to the use and the like.

Further, as the fuel evaporation gas introduced into the canister during the refueling flows from the introduction opening toward the open valve by detouring the partition, the whole adsorbing area can effectively used in adsorbing the fuel evaporation gas. By providing the communication valve in the communication pipe, as the in-tank pressure can be maintained higher than the atmospheric pressure by a specified pressure, the fuel evaporation gas generation can be prevented. As the open valve is mechanically controlled to open during the refueling according to the refueling condition and close when the vehicle is not being refueled, the control and construction can be simplified.

What is claimed is:

1. A fuel evaporation gas transpiration prevention system comprising:

a fuel tank for storing fuel to be supplied to an internal combustion engine;

a canister for adsorbing fuel evaporation gas from the fuel tank in an adsorbent provided in the canister;

a communication pipe for connecting the fuel tank to the canister;

a refueling determination means for determining whether a vehicle is in refueling condition; and a valve unit that connects an interior of the canister to atmosphere if refueling is determined by the refueling determination means, the valve unit also connects the interior of the canister to the atmosphere if the vehicle is not refueling and pressure within the fuel tank is higher than a predetermined value higher than atmospheric pressure, and the valve unit connects the interior of the canister to atmosphere if the vehicle is not refueling and fuel evaporation gas is to be supplied from the canister to an intake pipe, the valve unit shutting off interior of the canister from the atmosphere under any other condition.

2. The system according to claim 1, wherein the canister is divided into two chambers by a partition, on an end of the partition is provided a communication part to connect the two chambers, one of the two chambers is connected to a communication pipe on a side opposite to the communication part, and a remaining other of the two chambers is connected to an open valve on the side opposite to the communication part.

3. The system according to claim 1, further comprising:

a communication valve provided within the communication pipe for connecting the interior of the canister to the fuel tank if refueling is determined by the refueling determination means or if the pressure within the fuel tank exceeds the atmospheric pressure by a specified value.

4. The system according to claim 2, wherein the open valve is mechanically linked to be responsive to the refueling condition so as to open during refueling and close during non-refueling.

5. The system according to claim 1, further comprising:

a purge pipe connecting the canister to an intake pipe of the engine;

a purge valve disposed in the purge pipe;

a first in-take pressure detecting means for detecting an in-take pressure in the fuel tank if the valve unit and the purge valve are closed for a first predetermined period;

a second in-tank pressure detecting means for detecting, after detecting the in-tank pressure by the first in-tank pressure detecting means, the in-tank pressure in the fuel tank if the purge valve is opened for a second predetermined period;

a third pressure detecting means for detecting, after detecting the in-tank pressure by the second in-tank pressure detecting means, a pressure variation in the fuel tank if the purge valve is closed for a third predetermined period; and a fail determination means for determining a non-fail condition of the fuel tank and the communication pipe if one of the following conditions is satisfied: (A) the in-tank pressure detected by the first in-tank pressure detecting means is higher than the atmospheric pressure by a predetermined value, (B) the in-tank pressure detected by the second in-tank pressure detecting means is lower than the atmospheric pressure by another predetermined value, and (C) the in-tank pressure detected by the first in-tank pressure detecting means is at about the atmospheric pressure and the pressure variation detected by the third pressure detecting means is substantially zero.

6. A fuel evaporation gas transpiration prevention system comprising:

a fuel tank for storing fuel to be supplied to an internal combustion engine;

a canister for adsorbing fuel evaporation gas from the fuel tank in an adsorbent provided in the canister;

a communication pipe for connecting the fuel tank to the canister;

a refueling determination means for determining whether a vehicle having the fuel tank is in refueling condition;

an open valve that connects an interior of the canister to atmosphere if refueling is determined by the refueling determination means and shuts off the connection to atmosphere if the vehicle is not refueling;

a pressure control valve connected in parallel with the open valve for connecting the interior of the canister to the atmosphere if pressure within the fuel tank exceeds a predetermined value higher than the atmospheric pressure, thereby decreasing the pressure within the fuel tank to be less than the predetermined value; and an atmospheric introduction valve connected in parallel with the open valve and pressure control valve for connecting the interior of the canister with the atmosphere if the fuel evaporation gas is supplied from the canister to an intake pipe of the engine.

7. The system according to claim 6, wherein the canister is divided into two chambers by a partition, on an end of the partition is provided a communication part to connect the two chambers, one of the two chambers is connected to a communication pipe on the side opposite to the communication part, and the other of the two chambers is connected to an open valve on the side opposite to the communication part.

8. The system according to claim 6, further comprising:

a communication valve provided within the communication pipe for connecting the interior of the canister to the fuel tank if the refueling is determined by the refueling determination means or if the pressure within the fuel tank exceeds the atmospheric pressure by a specified value occurs.

9. The system according to claim 6, wherein the open valve is mechanically linked to be responsive to the refueling condition so as to open during refueling and close during non-refueling.

10. The system according to claim 6, further comprising:

a purge pipe connecting the canister to the intake pipe of the engine;

a purge valve disposed in the purge pipe;

a first in-tank pressure detecting means for detecting an in-tank pressure in the fuel tank if the purge valve is opened for more than a first predetermined period;

a second in-tank pressure detecting means for detecting the in-tank pressure in the fuel tank if the purge valve is closed for more than a second predetermined period; and a fail determination means for determining a non-fail condition of the canister, the fuel tank and the communication pipe if one of the following conditions is satisfied: (1) the in-tank pressure detected by the first in-tank pressure detecting means is lower than the atmospheric pressure by a predetermined value and (2) the in-tank pressure detected by the second in-tank pressure detecting means is lower than the atmospheric pressure by another predetermined value.

11. A fuel evaporation gas transpiration prevention system comprising:

a fuel tank for storing fuel to be supplied to an internal combustion engine;

a canister for adsorbing fuel evaporation gas from the fuel tank in an adsorbent provided in the canister;

a communication pipe for connecting the fuel tank to the canister;

a refueling determination means for determining whether a vehicle is in refueling condition; and a valve unit including a normally-closed electrically and pneumatically operable valve connected to the canister for selectively connecting the canister to atmosphere, wherein the valve unit electrically opens the normally closed valve only if refueling is determined by the refueling determination means, and pneumatically opens the normally closed valve only if an in-tank pressure within the fuel tank is higher than a predetermined value higher than an atmospheric pressure so that the in-tank pressure is limited to the predetermined if the vehicle is not refueling.

12. The system according to claim 11, wherein the valve unit further includes another normally closed valve which is opened pneumatically only if the fuel evaporation gas is supplied from the canister to an engine intake pipe.

13. The system according to claim 11, further comprising:

a purge pipe connecting the canister to an engine intake pipe;

a purge valve disposed in the purge pipe;

a first in-tank pressure detecting means for detecting an in-tank pressure in the fuel tank if the valve unit and the purge valve are closed for a first predetermined period;

a second in-tank pressure detecting means for detecting, after detecting the in-tank pressure by the first in-tank pressure detecting means, the in-tank pressure in the fuel tank if the purge valve is opened for a second predetermined period;

a third pressure detecting means for detecting, after detecting the in-tank pressure by the second in-tank pressure detecting means, a pressure variation in the fuel tank if the purge valve is closed for a third predetermined period; and a fail determination means for determining a nonfail condition of the fuel tank and the communication pipe if the in-tank pressure detected by the first in-tank pressure detecting means is higher than the atmospheric pressure by a predetermined value, the in-tank pressure detected by the second in-tank pressure detecting means is lower than the atmospheric pressure by another predetermined value, or the in-tank pressure detected by the first in-tank pressure detecting means is at about the atmospheric pressure and the pressure variation detected by the third pressure detecting means is substantially zero.

* * * * *